US005816882A

United States Patent [19]

Guegan et al.

[11] Patent Number: 5,816,882

[45] Date of Patent: Oct. 6, 1998

[54] CONSTRUCTION TOY KIT

[75] Inventors: Jacques Guegan, L'Hay les Roses; Francis Lecocq, Hames-Boucres; Jean-Pierre Moussaud, Les Attaques; Jean-Jacques Urvoy, Paris; Valerie Gautier, Paris; Francis Bance, Paris, all of France

[73] Assignee: Meccano, S.A., Calais, France

[21] Appl. No.: 781,502

[22] Filed: Jan. 9, 1997

Related U.S. Application Data

[63] Continuation of Ser. No. 268,537, Jul. 6, 1994, abandoned.

[30] Foreign Application Priority Data

Jan. 6, 1994 [WO] WIPO ..... OMPI DM/028335
Jan. 6, 1994 [WO] WIPO ..... OMPI DM/028336

[51] Int. Cl.[6] ..... A63H 33/12

[52] U.S. Cl. ..... 446/123; 446/75; 446/85; 446/86; 446/113; 446/118

[58] Field of Search ..... 446/75, 85, 86, 446/111, 113, 118, 122, 123, 124; 403/84, 91, 103, 21, 22; 411/84, 160, 161, 900, 908

[56] References Cited

U.S. PATENT DOCUMENTS

| | | | |
|---|---|---|---|
| D. 258,830 | 4/1981 | Sigg . | |
| D. 265,544 | 7/1982 | Nelson . | |
| D. 276,830 | 12/1984 | Petersson . | |
| D. 284,207 | 6/1986 | Kassai . | |
| D. 284,393 | 6/1986 | Kassai . | |
| D. 341,172 | 11/1993 | Olsen . | |
| 495,783 | 4/1893 | Cavallaro | 403/22 |
| 810,148 | 1/1906 | Hornby . | |
| 1,164,686 | 12/1915 | Wagner . | |

(List continued on next page.)

FOREIGN PATENT DOCUMENTS

| | | | |
|---|---|---|---|
| 523660 | 8/1921 | France | 446/122 |
| 605774 | 6/1926 | France | 446/123 |
| 736901 | 12/1932 | France | 446/113 |
| 927961 | 11/1947 | France | 446/113 |
| 2547343 | 4/1977 | Germany | 446/123 |
| 308001 | 6/1933 | Italy | 446/113 |
| 323308 | 6/1934 | Italy | 446/122 |

(List continued on next page.)

OTHER PUBLICATIONS

MECCANO® Junior ERECTOR® Publication, (marked "MARK X" for identification), published 1994; *Not Prior Art*.

MECCANO® Junior ERECTOR® Young Engineer 1540, published 1994; *Not Prior Art*.

MECCANO® Junior ERECTOR® Young Engineer 1530, published 1994; *Not Prior Art*.

MECCANO® Junior ERECTOR® Young Engineer 1355, published 1994; *Not Prior Art*.

(List continued on next page.)

*Primary Examiner*—Robert A. Hafer
*Assistant Examiner*—Jeffrey D. Carlson
*Attorney, Agent, or Firm*—Pennie & Edmonds LLP

[57] ABSTRACT

A construction toy kit comprises a plurality of construction elements and fasteners adapted for forming structures of various forms. The construction elements comprise straight flat strip, angled flat strips of various configurations, plates of various configurations, angled brackets of various configurations, blocks of various forms, and other accessories such as axle rods of various lengths, wheels, pulleys, locking clips, pin connectors, fasteners, spacers, washers, etc. Each of the construction elements has at least two holes of a same diameter, each hole having an associated concentric embossment formed therearound. The kit also includes a hand toy tool for tightening and loosening fasteners, which could also be used an accessory of the construction element. The kit further includes a container for holding the components thereof.

41 Claims, 20 Drawing Sheets

U.S. PATENT DOCUMENTS

| | | | |
|---|---|---|---|
| 1,166,688 | 1/1916 | Hornby . | |
| 1,242,202 | 10/1917 | Keller . | |
| 1,724,470 | 8/1929 | Gilbert . | |
| 1,736,310 | 11/1929 | Gilbert | 446/123 |
| 1,760,638 | 5/1930 | Gilbert . | |
| 1,763,300 | 6/1930 | Gilbert . | |
| 1,763,302 | 6/1930 | Gilbert . | |
| 1,779,826 | 4/1930 | Potter . | |
| 1,789,896 | 1/1931 | Gilbert . | |
| 1,804,927 | 5/1931 | Gilbert . | |
| 1,860,627 | 5/1932 | Sherman . | |
| 2,014,464 | 9/1935 | Bierbach . | |
| 2,082,138 | 6/1937 | Badel . | |
| 2,095,700 | 10/1937 | Heede . | |
| 2,498,221 | 2/1950 | Poupitch | 411/161 |
| 2,577,702 | 12/1951 | DeSwart . | |
| 2,733,786 | 2/1956 | Drake | 446/123 |
| 3,173,462 | 3/1965 | Koeppel . | |
| 3,315,376 | 4/1967 | Nielsen . | |
| 3,355,837 | 12/1967 | Pedersen . | |
| 3,528,192 | 9/1970 | Meates . | |
| 4,170,083 | 10/1979 | Freelander, et al. . | |
| 4,389,808 | 6/1983 | Podell | 446/86 |
| 4,551,110 | 11/1985 | Selvage et al. . | |
| 4,690,656 | 9/1987 | Friedman et al. . | |
| 4,872,410 | 10/1989 | Lilly . | |
| 4,903,451 | 2/1990 | Gresswell | 446/123 |
| 4,998,903 | 3/1991 | Bolli et al. . | |
| 5,007,636 | 4/1991 | Pagani . | |
| 5,035,324 | 7/1991 | Bertrand . | |
| 5,049,104 | 9/1991 | Olsen . | |
| 5,108,336 | 4/1992 | Rosier | 446/86 |
| 5,186,672 | 2/1993 | Tung . | |
| 5,228,796 | 7/1993 | Kao | 403/84 |
| 5,250,000 | 10/1993 | Boutin et al. | 446/75 |
| 5,454,746 | 10/1995 | Guegan et al. | 446/72 |

FOREIGN PATENT DOCUMENTS

| | | | |
|---|---|---|---|
| 116370 | 6/1918 | United Kingdom | 446/113 |
| 2 197 217 | 5/1988 | United Kingdom . | |
| 2229372 | 9/1990 | United Kingdom | 446/118 |
| WO 93/08885 | 5/1993 | WIPO . | |
| WO 93/08887 | 5/1993 | WIPO . | |

OTHER PUBLICATIONS

MECCANO® Junior ERECTOR® Young Engineer 1350, published 1994; *Not Prior Art*.

MECCANO® Junior ERECTOR® Young Engineer 1320, published 1994; *Not Prior Art*.

MECCANO® Junior ERECTOR® Young Engineer 1315, published 1994; *Not Prior Art*.

MECCANO® Junior ERECTOR® Young Engineer 1310, published 1994; *Not Prior Art*.

Catalog—Meccano ERECTOR® Junior, date unknown.

Catalog—Meccano ERECTOR® ,dated Nov. 1993.

Lego catalog excerpts, 1978.

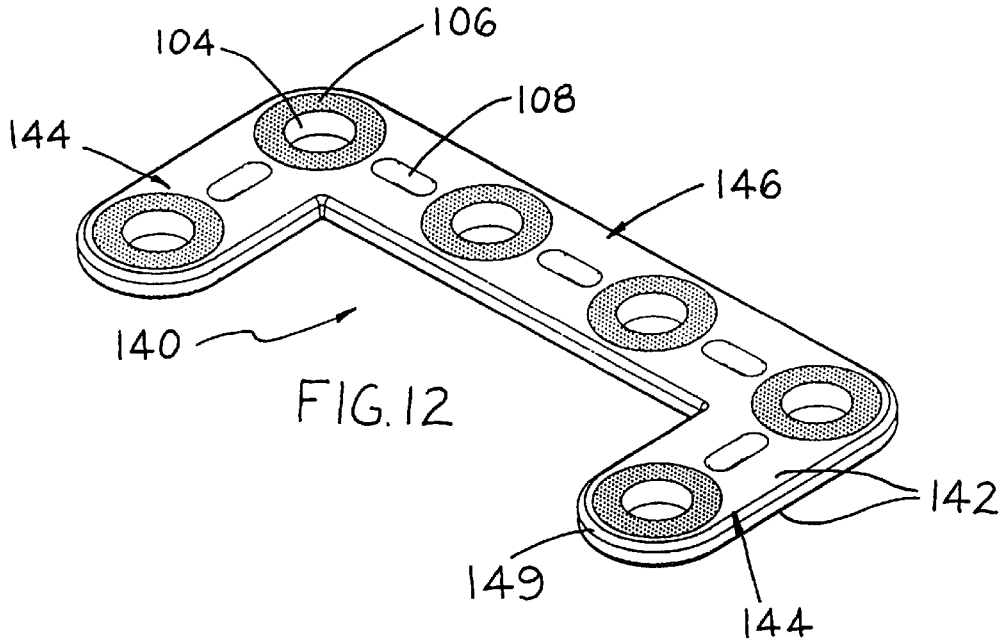
FIG. 12
FIG. 13
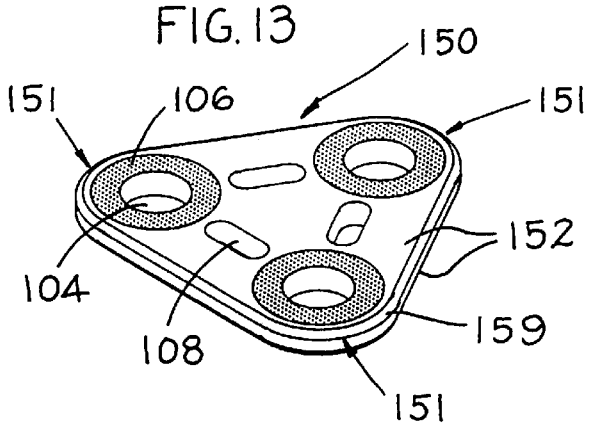
FIG. 14
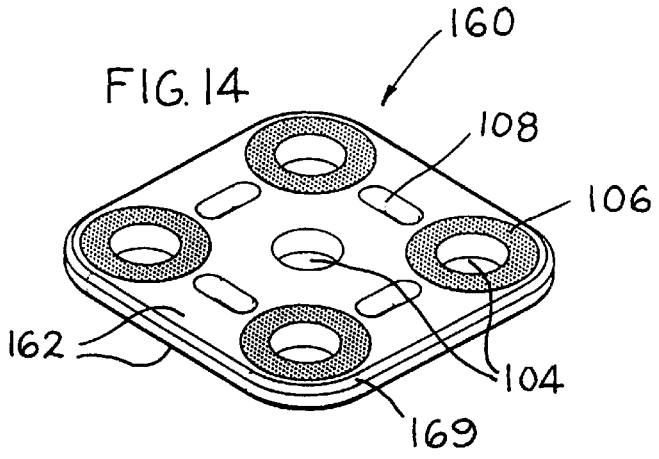

CONSTRUCTION TOY KIT

CONSTRUCTION TOY KIT

This is a continuation of application Ser. No. 08/268,537, filed Jul. 6, 1994, now abandoned.

This is also related to the following applications all filed on Jul. 6, 1994: Ser. No. 08/267.925, now U.S. Pat. No. 5,454,746 (identified by docket no. 8074-003); Ser. No. 29/025,820 (identified by docket no. 8074-005) now U.S. Pat. No. D380786; Ser. No. 29/025,818 (identified by docket no. 8074-011) now abandoned; Ser. No. 29/025,817 (identified by docket no. 8074-012) now U.S. Pat. No. D386545;

TECHNICAL FIELD

The present invention relates to a construction toy kit having a plurality of construction elements adapted for constructing various types of structures.

BACKGROUND

Construction toys for constructing various types of structures generally are packaged in a kit form. A construction toy kit can have a variety of structural components, fasteners, and accessories. Toy construction elements are typically made of a relatively elongated rigid flat plates of various lengths and/or sizes.

For instance, metal ERECTOR construction sets made by MECCANO, Inc. and construction sets disclosed in U.S. Pat. Nos. 1,860,627 issued to Sherman; 1,779,826 to Potter and 810,148 to Hornby use flat metal construction plates of various shapes and/or sizes. The plates are assembled or connected together using bolts and nuts or bolt-less types of fastening means. U.S. Pat. No. 1,860,627 also features a circular radiating rib or tooth-like embossment positioned around fastening holes.

U.S. Pat. No. 1,724,470 issued to Gilbert further discloses elongated plate like construction elements having perforations and mounting slots.

Construction elements can also be made of other materials as wood, plastic materials or the like to reduce the weight and cost. ERECTOR Junior SET construction kits made by MECCANO, Inc, U.S. Pat. Nos. 3,355,837 issued to Pederson and 2,577,702 to Swart disclose such toy construction elements which can be made of plastic materials.

Construction kits can even have elaborate mechanical mechanisms incorporating electrical motors and gears for driving, as disclosed for example in Metal ERECTOR construction sets made by MECCANO, Inc. and U.S. Pat. No. 1,164,686 issued to Gilbert.

Hand tools such as a screwdriver and a wrench are generally used to tighten or loosen fasteners such as screws, bolts, nuts, etc, which can be used with the construction toy kits described above. A screwdriver typically has a shank extending from a handle, with the end of the shank having a driver member integrally formed therewith or connected thereto. The driver member is shaped to engage a fastener and impart a rotational force thereto.

For example, U.S. Pat. No. Des. 341,172 issued to Olsen shows a toy tool having a triangular shaped driver member formed on the end of a shank. U.S. Pat. Des. No. 265,544 issued to Nelson shows a screwdriver having a female figurine shaped handle. U.S. Pat. Nos. 3,173,462 issued to Koeppel and 4,551,110 issued to Selvage et al disclose a typical hand operated screwdriver having a driver member consisting of a flat blade integrally formed on the end of the shank.

Hand tools can be included in the toy construction kit. However, they are merely used to tighten or loosen fasteners used with a toy construction kit. They generally serve no other purpose other than during assembly and disassembly of the construction elements. It would be advantageous for the toy kit to include a construction element that can serve as a hand tool.

Many different types of containers have been devised for storing or displaying toys or components of a toy construction kit, as disclosed for example in U.S. Pat. Nos. 5,250,000 issued to Boutin et al; 5,172,806 to Mickelberg; 5,035,324 to Bertrand; 5,007,636 to Pagani; 4,872,410 to Lilly; 1,804,927 to Gilbert. These containers are generally formed of a box-like or cylindrical configuration and sized to hold components therein. However, in order to retain all components in the container, the size must be made sufficiently large. Thus, it would be desirable to reduce the overall size of the container while still retaining all component parts therein.

SUMMARY OF THE INVENTION

The present invention is drawn to a toy construction kit comprising a plurality of construction elements and fasteners for connecting the elements and constructing various forms of toy structures. The construction elements comprise a pair of substantially parallel opposed surfaces and with at least two lateral sides. Each element has at least two spaced mounting holes of a predetermined diameter with an elongated slot formed between adjacent mounting holes. The elongated slot is substantially parallel to an imaginary line extending through centers of the two adjacent mounting holes or parallel to one of the lateral sides thereof. The slots are preferably all of the same size, the width thereof being substantially smaller than the diameter of the mounting hole and the length thereof being about the same or slightly larger than the diameter of the mounting hole. An embossment is formed concentrically around each mounting hole on each of the opposed surfaces. The embossment is a circular raised boss having a textured sandpaper like or roughened surface texture.

The elements comprise at least one elongated straight flat strip. Each elongated flat strip preferably has same thickness and width, with a pair of parallel longitudinal sides and rounded ends. It is also preferable to include straight flat strips of various lengths in the kit. Each of the flat strips has a pair of opposed parallel surfaces through which a plurality of equally spaced mounting holes are formed. The embossment is formed concentrically around each mounting hole on both surfaces thereof. The fasteners are adapted to fit in the holes in the construction elements and hold the construction elements together. The slot is also provided between each of the adjacent mounting holes.

The elements may further include angled flat strips of various shapes such as A-shape, L-shape, T-shape and C-shape, utilizing the above-described mounting hole, embossment and slot features of the flat straight strip. Specifically, the flat angled strip is formed by a pair of elongated leg strips integrally joined at right angles, with one mounting hole formed at each junction or vertex of the leg strips to form the L-shaped and T-shaped angled flat strips. Each of the leg strips is substantially similar to the flat elongated strip.

A third leg strip joined at right angles to a free end of one of the two leg strips can also be included to form an angled bracket having the C-shape. Similarly, many leg strips can be joined to the free ends of the legs strips to form various other configurations.

The elements further include plates of various geometric configurations such a triangle and a square. Similar to the straight flat strip element, each of the plates has a pair of opposed parallel surfaces and at least three sides. The plate also utilizes the above-described mounting hole, embossment and slot features of the flat straight and angled strips. Each of the slots extends parallel to one of the sides of the triangle or square.

Specifically, the triangular plate would have at least three mounting holes, one formed at each of the three vertexes. The triangular plate has at least three elongated slots, each formed between two adjacent mounting holes. The mounting holes extend parallel to one of the three sides. Each of the slots is parallel to one of the three sides. Preferably, the triangular plate forms an equilateral triangle.

The square plate preferably has at least four mounting holes, one formed at each of the four vertexes. The square plate has at least four elongates slots, each formed between two adjacent mounting holes. Moreover, the square plate preferably has a mounting hole formed at its center, but without any embossment formed therearound.

Similarly, the plate can form a polygon of any other shape utilizing the mounting holes, slots, embossments described above.

The construction elements according to the present invention can further include a plurality of angled strip brackets having an L-shape or C-shape utilizing the above-described mounting hole and embossment features of the flat straight strip. However, it is preferable to include embossments just on the outer side of the angled strips of these brackets. Each inner side is preferably provided with a nut recess so sized to hold a fastener such as a nut in a predetermined position to prevent the nut from rotating when tightening or loosening a bolt or screw that mates with the nut.

Specifically, the angular bracket comprises a pair of legs joined at right angles to form an L-shape. The bracket has an outer side and an inner side substantially parallel to the outer side. At least one mounting hole is formed through each leg with an embossment formed concentric around each mounting hole on the outer side. The recess is formed on the inner side of each leg, which extends from a free end thereof toward the junction of the legs.

The angular bracket can further include three angled legs, with a pair thereof joined to the ends of a third leg at right angles to form a U-shape. Again, at least one mounting hole is formed through each of the pair of legs and at least two mounting holes formed through the third leg. The embossment is formed concentric around each of the mounting holes on the outer side. A recess is formed on the inner side of each of the pair of legs, each recess extending from a free end thereof toward the junction of the third leg. The recess formed on the inner side of the third leg is rectangular sized to seat at least two fasteners. Alternatively, a plurality of square recess can be formed on the legs, each for seating one fastener.

The third leg can also have a flange extending perpendicular to the pair of legs. The flange also has at least two spaced mounting holes with the embossment formed concentric around each mounting hole on the outer side.

The construction elements according to the present invention can further include hollow blocks of various configuration, formed by walls connected at an angle with at least one open side. Certain of the walls are provided with mounting holes, embossments on the outer side thereof and recesses on the inner side thereof as described above with respect to the angled strip brackets. Furthermore, the blocks can have additional features such as raised mounting and aligning areas which are generally concentric with the mounting holes to permit stacking of the blocks.

Specifically, the block can have at least four walls with an opening to access the inner side thereof. At least three of the side walls each have at least one mounting hole with the embossment formed concentrically therearound on the outer side. A circular recess having a larger diameter than the mounting hole, but smaller diameter than the embossment is formed on the outer side of each mounting hole. Each mounting hole is provided with the recess on the inner side for seating a fastener.

More specifically, the block can form a cube having four side walls, a top wall, and an open bottom, each of the four side walls and the top wall having a mounting hole with the embossment and the circular recess on the outer side, and the recess for seating a fastener on the inner side.

The construction elements can further include a rectangular block which in essence is two or three of the cubic blocks joined side-by-side with a pair of common opposed side walls, with each of the pair of opposed side walls and the top wall having at least two mounting holes.

The construction elements can further include a rectangular block having each of its four side walls with two mounting holes and its top wall with at least four mounting holes. Preferably, the top wall has another mounting hole formed at its center.

The construction elements can further include a sloped block having four side walls, a top wall, and an open bottom, with only the three of the four side walls and the top wall each having at least two mounting holes. The side wall without the mounting hole is preferably sloped.

The construction elements can further include a curved block having four side walls and an open bottom, with one of the side walls being curved. The other three side walls each have at least three mounting holes.

The construction elements can further include a cab block having two opposed side walls joined by a bottom wall, a back wall and a front curved wall, with the front wall extending upwardly only partially, leaving a substantially open front wall. Each of the side, back, bottom walls has at least two mounting holes.

The cab block can additionally include a pivotally and removably connected windshield to cover the substantially open front wall. A circular collar extends upwardly from the center of the bottom wall thereof, which is dimensioned to seat or receive other elements.

The construction elements according to the present invention can further include accessories such as an axle rod having a plurality of evenly spaced curved notches formed along its axial or longitudinal direction. Specifically, the axle rod has at least one longitudinal channel extending the entire length thereof. A row of notches are formed within each channel. Preferably, a pair of diametrically opposed channels extend the entire length of the axle rod, with the row of notches formed within each channel.

The axle rod is substantially circular so to permit the a rotatable connection with a wheel, pulley, or crank. A locking clip having at least one tab is used to maintain any attached wheel and/or pulley from axially moving. Specifically, the notches have peaks and valleys cooperating with the tab to frictionally interlock the locking clip at a desired position relative to the axle rod. Similarly, the crank has a substantially elongated body, a handle rotatably connected thereto and an opening in the body dimensioned to permit the axle rod to be inserted thereinto. The crank has at least one tab that cooperates with the notches formed on the axle rod to interlock the crank to the axle rod. The channel and the tab prevent relative rotational movement between the axle rod and the locking clip, as well as the crank.

Preferably, each of the locking clip and the crank has a pair of opposed tabs for engaging with the axle rod with preferred pair of channels. Specifically, each of the tabs extends substantially radially into the central opening formed through the locking clip and the crank opening, the tabs cooperating with the peaks and valleys to lock them relative to the axle rod.

The construction elements can further include a connection pin which snaps into the mounting hole formed in the block to connect the blocks to each other. The connection pin comprises a substantially elongated tube, with a portion of the tube having an outer diameter substantially same as that of the mounting hole formed in the block. A central circular flange is formed concentrically with the tube and centrally of the portion. A ridge having a larger diameter than the mounting hole formed in the block is formed adjacent the central flange on either side thereof. There is a spacing between the flange each of the ridges which is about the thickness of the wall of the block at the area of the circular recess to permit the connection pin to snap fit into the mounting hole. A pair of diametrically opposed slots extend along the longitudinal or axial direction of the tube. Each of the slots extends from its free end toward the opposite end, the length thereof being greater than about three-quarter of the total length of the tube, with one slot extending from one end toward the other end and the other slot extending from the other end toward the one end.

The diameter of the circular flange is substantially equal to or slightly less than the circular recess formed concentrically around the mounting hole. The thickness of the flange is greater than but no greater than twice the depth of the circular recess to permit the flange to be seated flush in the circular recess.

The construction elements can further include a base platform on which the construction elements can be attached to. Specifically, the base platform has a plurality of holes with recessed upper areas sized and shaped to receive fastening nuts. More specifically, the platform has a plurality of rows of uniformly spaced upper recesses each having a concentric mounting hole dimensioned for accepting a fastener. In between adjacent rows of the upper recesses, the platform has a row of uniformly spaced mounting holes each dimensioned also for accepting the fastener. Four legs preferably extend downwardly from the underside of the platform.

Another feature of according to the present invention is that the base platform can also be used lock a container which stores the elements. In particular, the container according to the present invention for storing the construction elements has a main body shaped in the form of a box with an open top, four side walls and a bottom. The open top is provided with a pivotable closure which may be maintained in a closed position using the base platform. The closure includes means for receiving the base platform, while the base platform includes means for engaging the closure to retain the container in a closed position. The base platform receiving means comprises four holes while the base plate engaging means comprises the four legs extending from the base platform.

More specifically, the closure comprises a pair of flap members pivotally connected to the main body and pivotable between an open position in which the flap members are pivoted away from each other and a closed position in which the flap members are pivoted toward each other. Each of the flap members define a generally flat supporting upper surface with two leg holes and a pair of opposed side extensions extending downwardly from the opposite ends of the upper surface. The opposed side extensions of each of the flap members are pivotally connected to the same opposite side walls of the main body. When the flap members are in the closed position the upper surfaces of the two flap members are generally co-planar.

The leg holes formed in the flap members are aligned with the legs when they are closed to permit the legs to pass therethrough and permit the base platform to engage the upper surfaces of the flap members. The base platform accordingly interlocks the flap members and the container in a closed position.

Preferably, a handle is provided for the container. The handle may be slideably and pivotally attached to the opposite side walls of the main body of the container. The base platform is preferably provided with a longitudinal recess for receiving the handle.

A construction kit according to the present invention can further include a hand held toy tool which can serve a secondary toy function. The tool according to the present invention comprises a longitudinal shank connected to a handle. The shank is substantially circular and has a dimension smaller than the diameter of the mounting hole of the elements to permit the shank to pass therethrough. A driver member is formed on the free end of the shank. The tool further has a cap adapted to completely cover the shank and the driver member and engage the handle.

When the cap is engaged with the handle, they form a human-like figure which can be used as a part of a construction toy. Specifically, the handle is shaped as a lower half of a human figure, i.e., the leg portion, whereas the cap is shaped as an upper half of a human figure, including a head portion. The cap and the handle together complete a human-like figure.

The cap comprises a longitudinal chamber dimensioned to permit the shank to pass therethrough. The head portion of the cap is hollow and is provided with a shank engaging portion dimensioned to frictionally engage the shank such that the cap is maintained in position relative to the handle portion when engaged.

The handle is provided with an alignment projection that cooperates with a hole formed on the cap to correctly align the lower body (handle) with the upper body (cap).

According to the toy tool of the present invention, the driver member preferably has a triangular shaped cross-section for driving a fastener with a triangular recess. The tool can have a removably connectable extension driver member. The extension driver member mates with the driver member and is provided with a substantially identical driver member and/or other types of driver members for a quick interchangeability.

Advantageously, the cap has a circular recess formed at its lower end which is so dimensioned to frictionally fit over the fastener such that it can be lockingly attached to the structure formed by the kit.

The fastener according to the present invention preferably comprises a square nut and a bolt comprising a threaded shank and an enlarged circular head. The mounting hole is dimensioned to receive the threaded shank. The circular recess formed at the cap is dimensioned to frictionally seat the head of the bolt.

Moreover, the circular collar formed on the cab block has a diameter substantially identical to the diameter of the bolt head such that the cap also frictionally seats on the cab block circular collar.

Each of the recesses formed on the brackets and the blocks is dimensioned to seat the nut and maintain it in a predetermined substantially fixed position. That is, the recess prevents the nut from rotating during tightening and loosening of the bolt.

BRIEF DESCRIPTION OF THE DRAWINGS

These and other features, aspects, and advantages of the present invention will become much more apparent from the following description, appended claims, and accompanying drawings where:

FIG. 12 is a perspective view of a flat C-shaped strip according to the present invention.

FIG. 13 is a perspective view of a triangular plate of according to the present invention.

FIG. 14 is a perspective view of a square plate according to the present invention.

DETAILED DESCRIPTION OF THE PREFERRED EMBODIMENT

Although reference herein is made to directions such as front, rear, top, bottom, side, they are made merely with respect to the drawings illustrated in the Figs. Such reference is simply for the sake of convenience of description and is not intended to limit the present invention in structure or operation in any way, manner or form.

Figure 1:
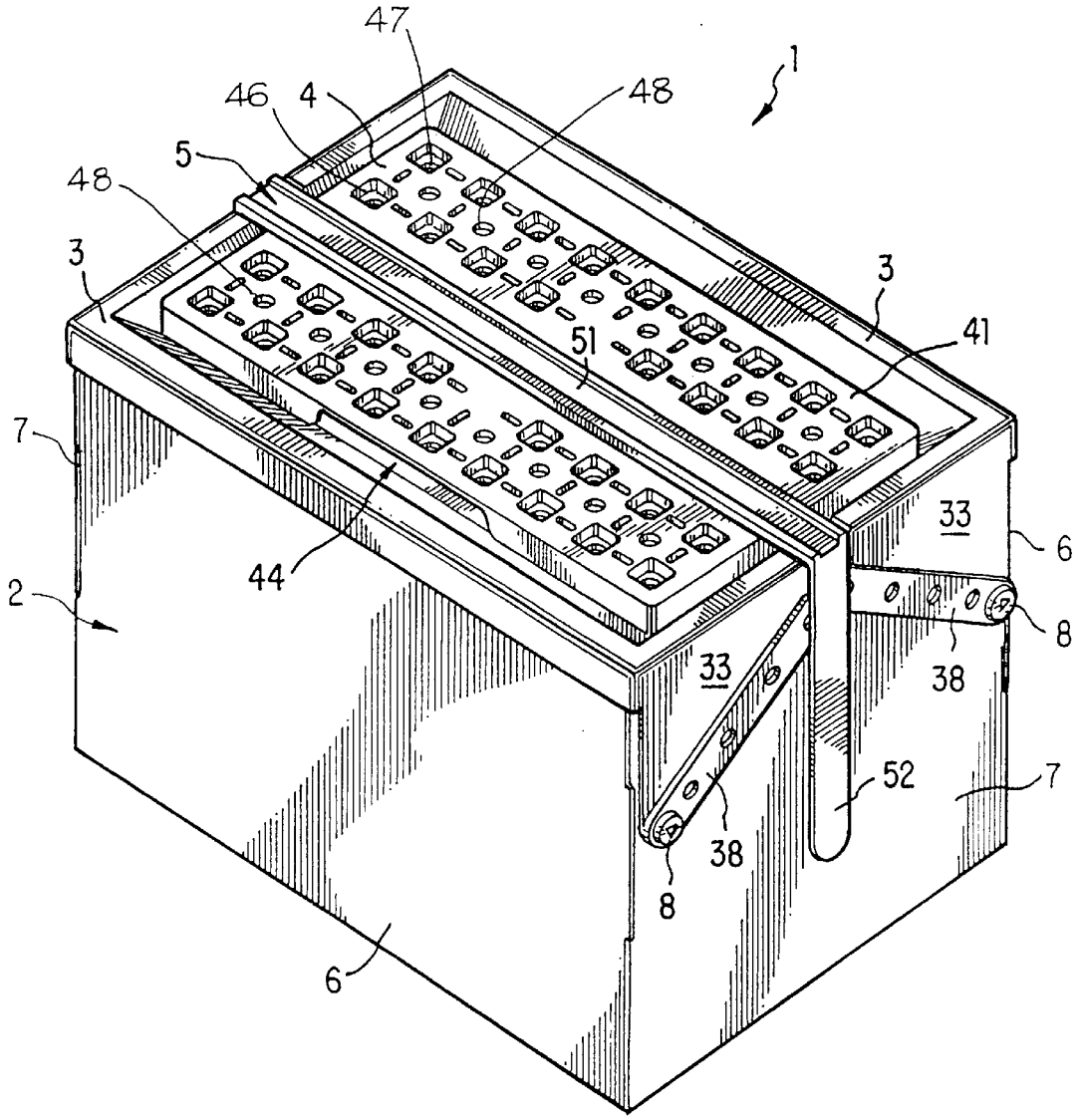
FIG. 1 is a perspective view of a container for storing the components of a toy kit according to the present invention, showing a pair of flap members in their closed position with a base platform disposed thereon.
Figure 2:
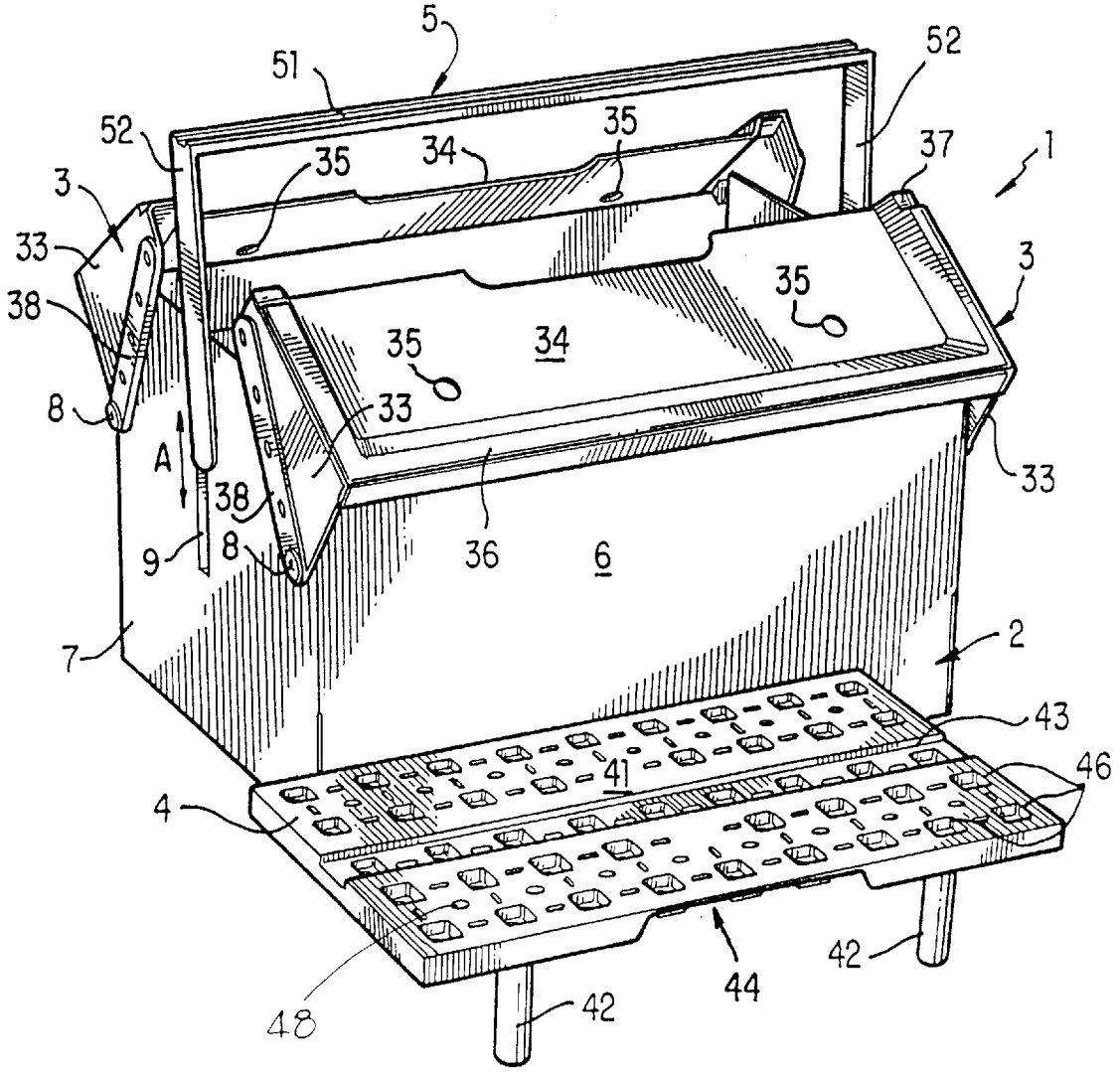
FIG. 2 is a perspective view of the container of FIG. 1 showing the flap members in a partial open position with the base platform removed.
Figure 3:
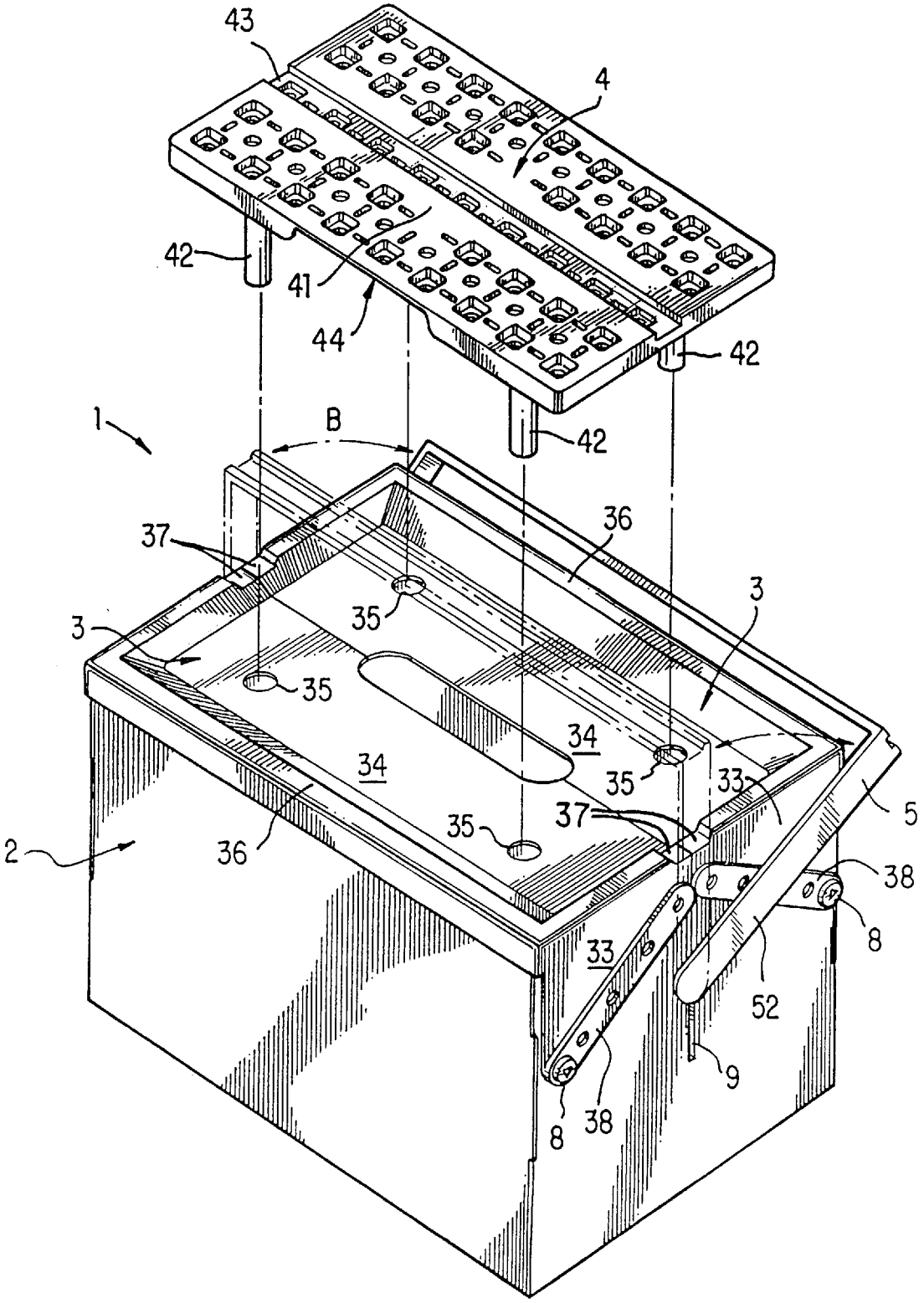
FIG. 3 is a perspective view of the container of FIG. 1 shown with the flap members in the closed position, the handle pivoted to the side and the base platform aligned with the flap members for insertion.

FIGS. 1–3 show the container 1 according to the present invention for storing the construction kit. The container has a main body 2 preferably in the form of either a square or rectangular box having a bottom, four side walls and an open top. The container includes a closure 3, a separate planar base platform 4 and a handle 5. For purposes of the following description, left/right side walls of the main body 2 have been referred to as side walls 7, and front/rear side walls as side walls 6.

The closure comprises a pair of flap members 3 pivotally connected to the side walls 7 of the main body 2 and pivotable between an open position in which the flap members are pivoted away from each other and a closed position as shown in FIGS. 1 and 3 in which the flap members are pivoted toward each other. FIG. 2 shows the flap members in a partially open position. In the complete open position, the flap members are preferably pivoted away from each other to completely expose the open top for easy access to the opening. As better shown in FIGS. 2 and 3, the two flap members are mirror images of each other.

Each of the flap members is defined by a generally flat recessed planar upper surface 34 with at least one hole 35, two holes being preferred as shown in FIGS. 2 and 3, and a pair of opposed side extensions 33 extending preferably substantially perpendicularly from the opposite ends of the upper surface 34. Each of the opposed side extensions is preferably substantially planar and preferably has a right-triangular pattern. A reinforcement 38 in the form of a strip, preferably of a plastic material, is formed on each of the hypotenuse sides thereof. Each of the lower vertex of the side 33 is pivotally connected to one of the opposite side walls 7 of the box, preferably using a plastic bolt 8 and a nut (see FIGS. 24A and 24B). When the flap members are in the closed position the upper surfaces of the two flap members are generally co-planar as shown in FIG. 3.

The outer periphery 36 of each of the upper surfaces 34 is preferably provided with a pair of opposed recesses 37 at the ends thereof to receive the handle 5. The depth of the recesses are such that the handle sits substantially flush with the outer periphery 36 of the upper surface 34 when the handle is retracted downward.

As shown in FIG. 3, each of the free edge of the recessed upper surface 34 is provided with a cut-out, with both cut-outs forming an elongated oval shape for permitting insertion of fingers or an implement for lifting the flap members open.

The base platform 4 comprises a planar base plate 41 corresponding to the shape and size of the recessed upper surfaces 34 when they are co-planar, preferably either square or rectangular, corresponding to the box configuration. The base plate is provided with at least two legs 42 extending perpendicularly therefrom, the total number of the legs being less than or equal to the openings formed in the upper surfaces 34. The holes formed in the planar surfaces are aligned with the legs to permit the legs to pass therethrough and permit the platform 4 to sit flush on the upper surfaces of the flap members. The holes may be sized to be slightly larger than the legs so that the legs easily pass therethrough. Alternatively, the legs can be provided with an end portion which snap-locks the legs into the holes. Further, the legs can be sized to frictionally engage the inner diameters of the holes to secure the platform. If desired, the legs may be configured with a first portion that has a smaller diameter than the hole and a second portion which progressively frictionally engages the hole to secure the legs therein. Of course, when used, not all legs and holes need to have these locking features, as only one is sufficient.

Advantageously, the platform 4 interlocks with the flap members to securely retain them in a closed position. As shown, the platform 4 preferably has four legs 42, corresponding to four holes formed on the upper surfaces 34 of the flap members. The platform 4 is a component of the construction kit itself and includes a plurality of recessed areas 46 with mounting holes sized and shaped to receive fastening nuts. More specifically, the platform has a plurality of rows of uniformly spaced upper recesses 46 each having a concentric mounting hole 47 dimensioned for accepting a fastening bolt. In between the adjacent rows of the upper recesses, the platform includes a row of uniformly spaced mounting holes 48 having a same dimension as the mounting hole 47 also for accepting the fastening bolt.

The base plate preferably includes a central longitudinal recess 43, shown in FIG. 2, for receiving the handle 5 when the container 1 is in the closed position and the handle retracted down, as shown in FIG. 1. Moreover, the base plate preferably further includes a pair of opposed cut-outs 44 formed at the opposite sides and underneath thereof, parallel to the handle 5 to permit insertion of fingers or an implement to facilitate removal of the platform 4 from the flap members 3.

Preferably, the handle 5 is slideably and pivotally attached to the opposite side walls 7 of the box container. The longitudinal recess 43 receives the handle when it is retracted down. The handle also serves to maintain the platform in place. The handle is preferably U-shaped with a flat intermediate portion 51 and a pair of vertical segments 52 extending from opposite ends thereof. The vertical segments 52 of the handle are slideably and pivotally disposed on the vertical slots 9 formed at the opposite side walls 7 of the box. Although not shown, each of the vertical segments are provided with a pin or like that extends through the slot. The handle can be raised up and pressed down in the direction of a double arrow A as shown in FIG. 2 and pivotable as well in the direction of a double arrow B as shown in FIG. 3 to facilitate insertion and removal of the platform and to provide easy access to the inside of the container.

Although the closure and platform are preferably engaged using the legs and holes as described above, it will be apparent to one of ordinary skill in the art that many other means can be used to achieve this engagement. For example, the platform receiving means of the closure and the closure engaging means of the platform can be formed of any components that can be connected or attached. For example, one could be of the hook material of a hook and loop fastener (i.e., VELCRO), while the other can be made of the loop material. One could instead be the protruding portion of a snap connector, while the other is the recess portion of the connector. More elaborate interlocking members can be used, if desired. The main purpose of these means is to removably secure the platform to the closure.

The main body or box, the flap members, and handle can be made of any suitable material, such as a cardboard, plastics, and metal. However, it is preferable to form the flap members, the handle and the platform of a plastic material for durability.

Figure 4:
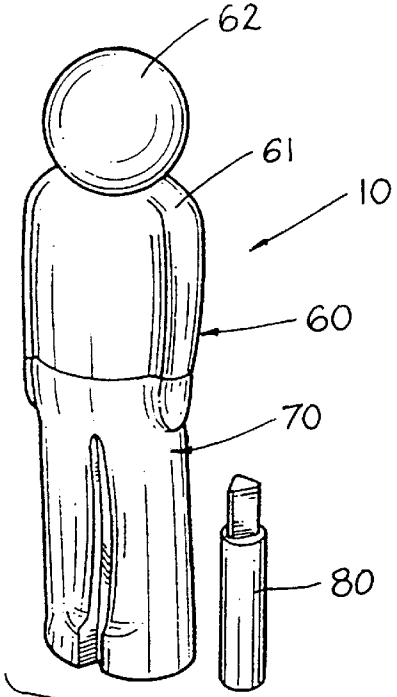
FIG. 4 is a perspective view of a screwdriver according to the present invention, with the cap and handle engaged to form a human-like figure, and a separate extension.

FIG. 4 shows a perspective view of a human-like figure shaped toy tool 10 according to the present invention, with a separate driver extension 80. The tool 10 comprises a handle 70 that is shaped as a lower half a human figure, i.e., the leg portion, and a cap 60 that is shaped as an upper half of a human figure, including a head. The handle 70 together with the cap 60 completes a human-like figure.

Figure 5:
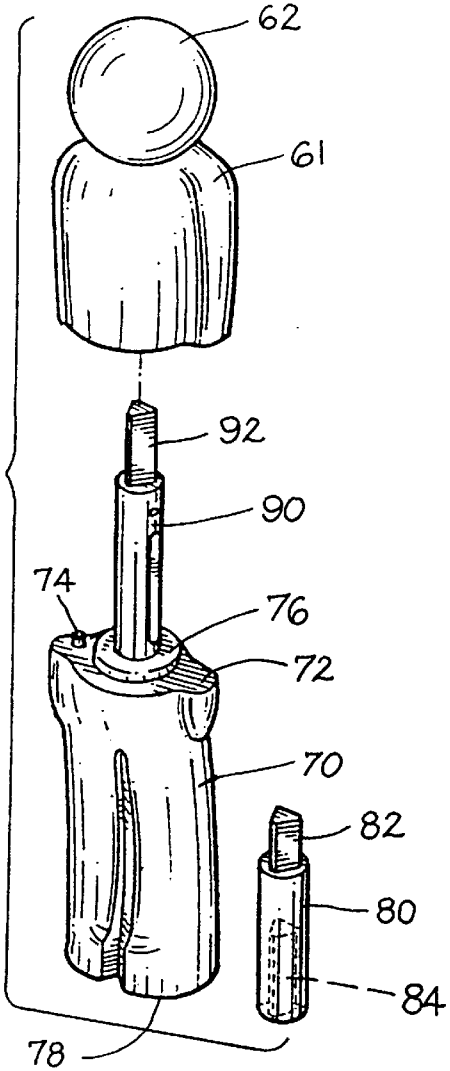
FIG. 5 is a perspective view similar to FIG. 4, with the cap removed to show the shank and the driver member.

FIG. 5 is shown with the cap 60 detached from the handle 70 to show the handle in its entirety. Specifically, a longitudinal shank 90 extends from an end 72 of the handle. The end 72 is preferably substantially flat. The shank 90 is fixedly connected to the handle or integrally formed therewith so that there is no relative rotative movement between the shank and the handle. The diameter of the shank is substantially same as that of an axle rod 340 so that it can pass through a mounting hole 104 formed on the construction elements. A driver member 92 extends substantially collinearly with the longitudinal axis of the shank. The driver member preferably is integrally formed with the shank and has a triangular cross-section for engaging a complementary triangular shaped recess formed in the fastener. However, the driver member could have any other geometric configuration, such as a hexagon (allen wrench), star (torx wrench) or square, either as a relief or recess configuration, or as a conventional phillips or flat head configuration.

Moreover, different types of driver member configurations can be readily attached to the driver member 92 in the form of a driver extension. Specifically, although one extension 80 is shown with a same triangular geometric configuration driver member 82 as the driver member 92, the driver member 82 can be of any other geometric configuration mentioned above. Accordingly, different types of driver members can be readily provided as desired by merely changing the extension. The other end of the extension 80 has a recess 84 complementary to the geometric shape of the driver member 92, i.e., a triangular recess for the triangular driver member 92.

Figure 6:
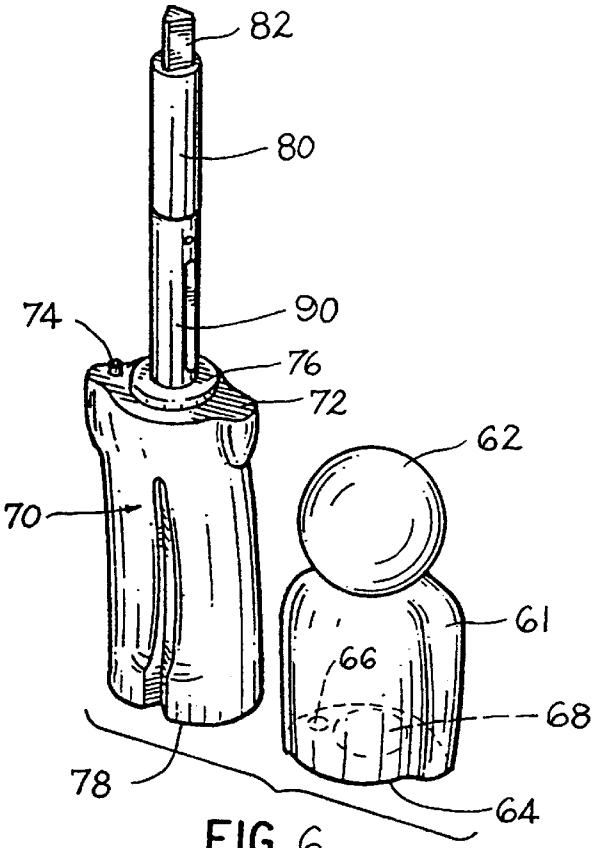
FIG. 6 is a perspective view similar to FIG. 5, with the extension attached to the driver member.

FIG. 6 shows the extension 80 inserted over the driver member 92. The extension also permits the tool to reach into deeper or recessed areas by increasing the overall working length of the shank.

Figure 7:
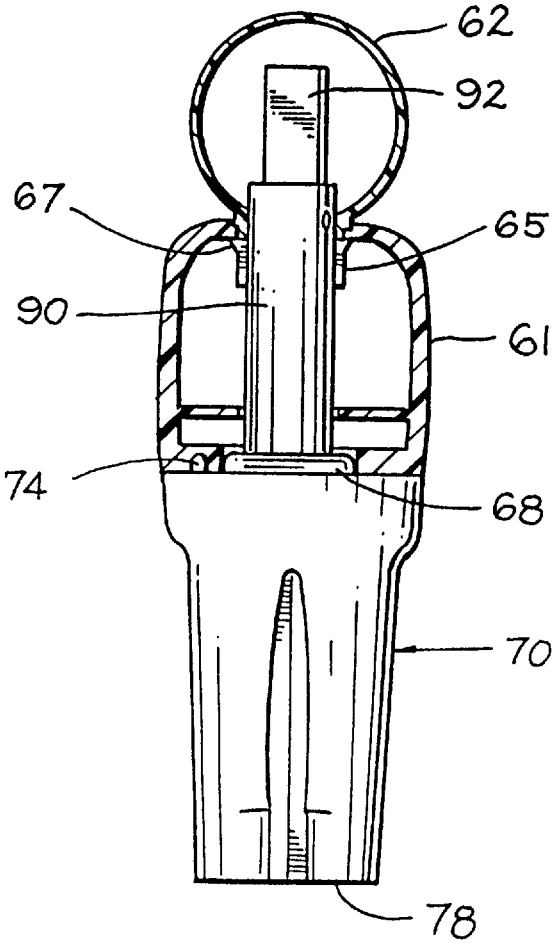
FIG. 7 is a front sectional view of FIG. 4, showing the cap engaged with the handle and the shank thereof.

As more clearly shown in FIG. 7, the cap 60 comprises has a head shaped member 62 connected to a body 61. The head shaped member 62 is preferably rotatably connected to the upper end of the body. As shown in FIGS. 6 and 7, the lower end 64 of the body is substantially flat so that it can stand upright on a flat surface and is provided with a circular recess 68.

The lower end or foot 78 of the handle is also preferably formed flat so that the tool 10 can stand upright on a flat surface. The flat end 72 of the handle engages with the flat end 64 of the body 61 as shown in FIG. 7. The flat end 72 of the handle is provided with an alignment projection 74 for engaging a complementary alignment hole 66 formed on the flat end of the body 61. The projection 74 helps to align the lower body 70 with the upper body 60 to complete the human-like figure. The projection 74 also prevents the cap 60 from rotating relative to the handle 70.

The flat end 72 of the handle is preferably provided with a collar 76 of a predetermined diameter corresponding to the circular recess 68 formed in the flat end of the body 61. The collar 76 engages the recess 68 when the cap 60 is pulled over the shank to permit a frictional engagement. Also, the collar 76 cooperates with the alignment projection 74 and the alignment hole 66 to maintain a proper human-like configuration when the cap is engaged with the handle as shown in FIGS. 1 and 4.

As shown in FIG. 7, the head shaped member 22 is preferably hollow to permit insertion of a portion of the shank 90 which is preferably substantially cylindrical and the entire driver member 92. The head shaped member has an integral cylindrical neck portion 65 that extends into an opening formed in the upper end of the body. The neck portion is frictionally engaged to the body to permit rotation of the head member relative to the body. The neck portion is provided with a one-way snap fit tapered circular ridge 67 that has a larger diameter than the opening occupied by the neck portion. The tapering shape of the ridge permits insertion into the body, but is made difficult for removal in the opposite direction. Specifically, the cylindrical neck portion is provided with at least a pair of diametrically opposed vertical slots (not shown) to permit the diameter of the neck portion to decrease when pushed into the opening formed in the upper end of the body, but returned to its normal dimension once the neck portion is placed into the opening. The ridge, however, permits removal of the head shaped member from the body when pulled with enough force.

The inner diameter of the neck portion is preferably dimensioned to frictionally engage the shank so that it can maintain the cap in its place relative to the handle.

The toy tool according to the present invention has a separate utility other than as a tool. Specifically, with the cap in its place relative to the handle, the human-like figure can be used as a part of a construction kit. In particular, in a toy construction kit, either just the cap or the entire human-like configured tool can be placed as a driver of a car, a pilot of a plane or an engineer of a train, etc. Particularly, the recess 68 is dimensioned such that it frictionally fits over the circular bolt head 312 (FIGS. 24A and 24B). More particularly, the bolt head protrudes from the surface of the component being connected therewith. The cap 60 may then be placed over the bolt head. The frictional engagement therewith maintains the cap relative to the bolt head. Moreover, the foot 78 or the recess 68 of the cap can be used to stably interfit or connect with a complementary fittings formed on the components of the construction kit as described below with respect to the cabinet block 250 shown in FIGS. 23A, 23B, 23C, 23D.

The entire hand tool can be made of any suitable plastic, wood or metal. However, it is preferable to form the hand tool from plastic materials such as ABS, nylon, etc.

The construction elements of the construction kit according to the present invention further comprises a plurality of flat straight strips 100 of various lengths; various angled strips of L-shape 110, T-shape 120, A-shape 130, and C-shape 140; plates 150 and 160 of various shapes such as triangular and square as shown in FIGS. 8–14.

With respect to the construction elements 100, 110, 120, 130, 140, 150 and 160, their opposed top and bottom sides 102, 112, 122, 132, 142, 152 and 162 are substantially flat, parallel and identical. These elements all have a same thickness. All of these elements also have at least two spaced mounting holes 104 of same diameter and spacing. Each mounting hole is dimensioned to accept the bolt 310. A pair of circular embossments or raised bosses 106 are formed concentrically around each mounting hole 104, one on each side 102 thereof. The embossments are slightly raised from the flat surfaces of the top and bottom sides 102. In particular, each of the embossments are raised about 0.1 mm thick and have a roughened surface texture, akin to that of a sandpaper, to enhance friction. However, the embossments can be made thicker as desired and with different textures or roughness. The bosses can also be made of different shapes, such as a rectangle and can be formed through any conventional plastic molding process.

Each of these elements further comprise at least one elongated slot 108 arranged between the two adjacent mounting holes 104. Moreover, each of the angled corners 109, 119, 129, 139, 149, 159 and 169 joined at right angles is preferably contoured smooth or beveled to remove any sharp edge.

Figure 8:
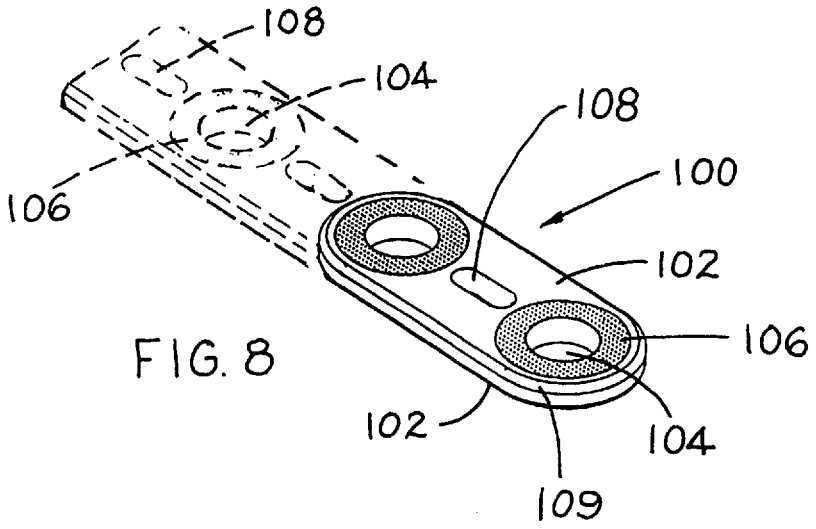
FIG. 8 is a perspective view of a straight flat strip according to the present invention.

FIG. 8 shows a straight flat strip 100 having a pair of flat opposed parallel sides 102 having a uniform width and thickness. The flat strip 100 has at least two spaced mounting holes 104 and embossments 106 discussed above arranged along the longitudinal direction thereof. Any number of mounting holes can be can be provided, thus providing strips 100 of different lengths.

Figure 9:
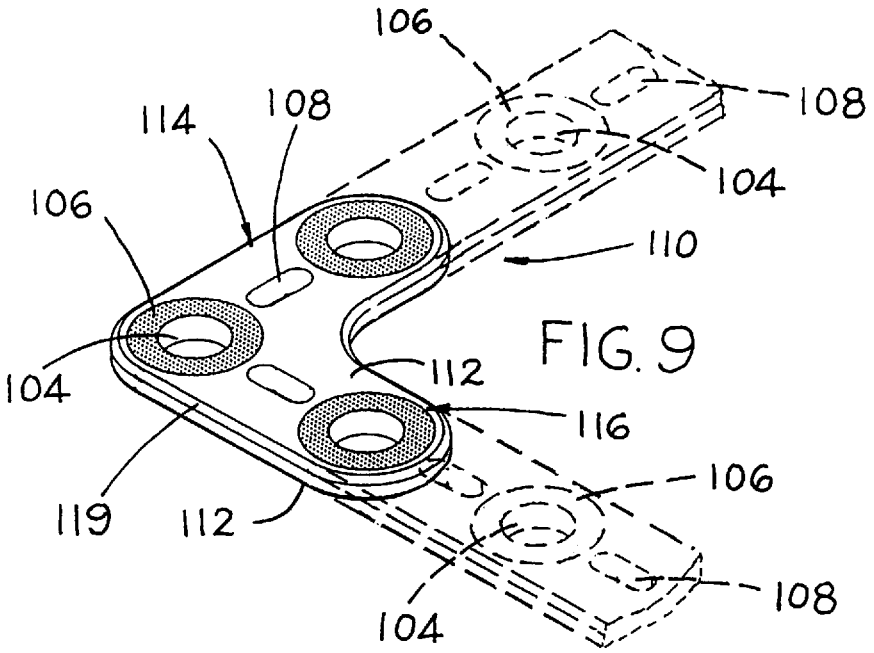
FIG. 9 is a perspective view of an flat L-shaped strip according to the present invention.

FIG. 9 shows a flat L-shaped or corner strip 110 according to the present invention. The flat L-shaped strip 110 has a pair of opposed parallel flat surfaces 112 on which the embossments 106 are formed. The strip 110 has a pair of legs 114, 116 joined at right angles to form an L-shape. At least three mounting holes 104 are formed as shown in FIG. 9, with one mounting hole formed at the vertex of the legs. Each of the two legs is similar to the elongated flat strip 100.

Figure 10:
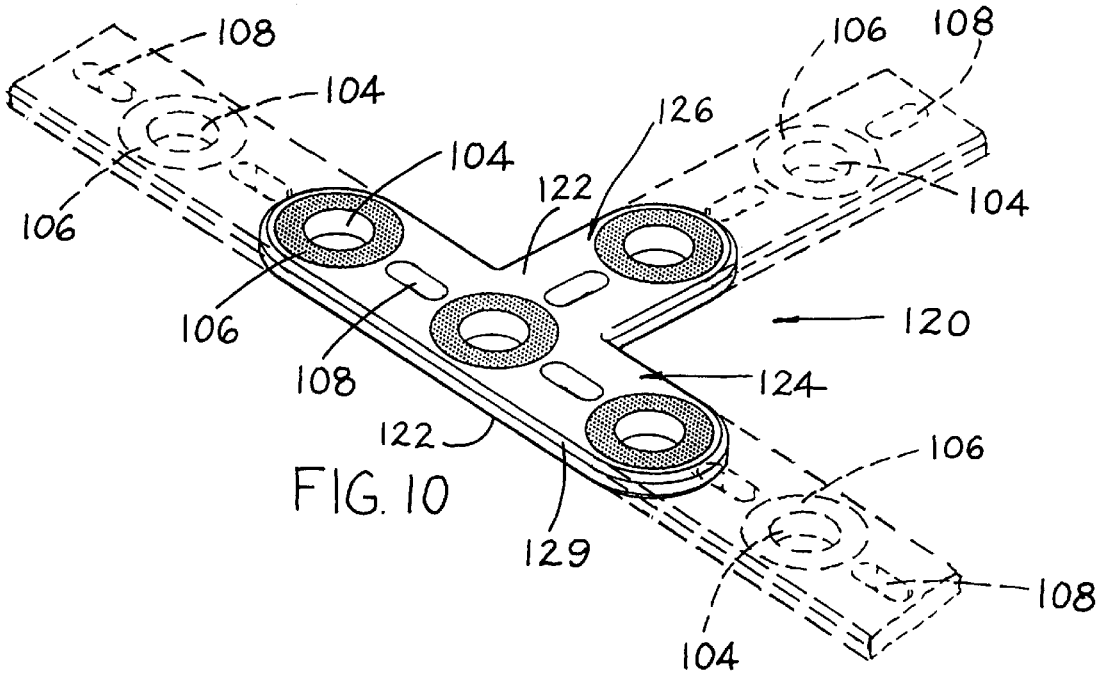
FIG. 10 is a perspective view of a flat T-shaped strip according to the present invention.

FIG. 10 shows a flat T-shaped strip 120 according to the present invention. The flat T-shaped strip 120 has a pair of opposed parallel flat surfaces 122 on which the embossments 106 are formed. The strip 120 has a pair of legs 124, 126 joined at right angles to form a T-shape. At least four mounting holes 104 are formed, with one mounting hole formed at the vertex of the legs. Each of the two legs is similar to the elongated flat strip 100.

With respect to the elements of FIGS. 8–10, any number greater than equal to the minimum number of mounting holes suggested above can be provided to form different length strips 100 as shown by the phantom lines. Similarly, each leg of the angled strips 110 and 120 can be provided with any number of mounting holes to form various lengths as shown by the phantom lines. However, the spacing between two adjacent mounting holes is uniform throughout or multiples thereof. Furthermore, each of the ends of the strips 100, 110, 120 is preferably rounded as shown by the solid lines.

Figure 11:
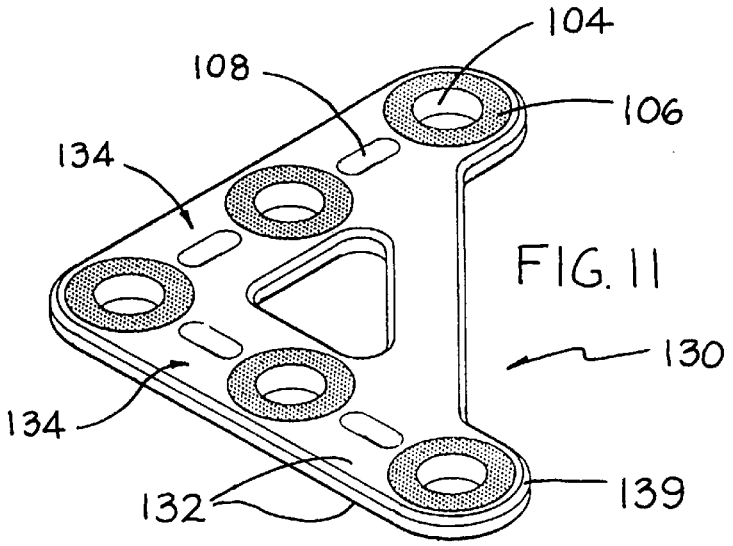
FIG. 11 is a perspective view of a flat A-shaped strip according to the present invention.

FIGS. 11 and 12 show flat angled brackets 130 and 140 of various configuration according to the present invention. The flat bracket 130 has a pair of opposed parallel surfaces 132 on which the embossments 106 are formed, and a pair of identical legs 134 joined at right angles similar to the L-shaped bracket shown in FIG. 9. A relatively thin reinforcement 138 spans across the legs to form an A-shaped bracket 130. Each of the two legs is similar to the elongated flat strip 100, with the same spacing between two adjacent mounting holes 104. At least five mounting holes are formed in the flat bracket 130.

The flat bracket 140 shown in FIG. 12 has a pair of opposed parallel surfaces 142 on which the embossments 106 are formed and three legs 144 and 146. A pair of identical legs 144 are each joined at right angles to the ends of the leg 146 in a same plane, forming a C-shape or U-shape. Each of the three legs is similar to the elongated flat strip 100, with the same spacing between two adjacent mounting holes 104. At least six mounting holes are formed in the flat bracket 140, with one mounting hole formed at each vertex of the legs.

FIGS. 13 and 14 show plates 150 and 160 of various geometric configuration according to the present invention. The plate 150 has a pair of flat opposed parallel surfaces 152 on which the embossments 106 are formed. The plate 150 forms an isosceles triangle with three identical corners 151 and three mounting holes, one mounting hole 104 being arranged at each of the corners. Each of elongated slots 108 is formed parallel to one of the sides thereof. Again, the spacing between two adjacent mounting holes is identical to that of the flat strip 100.

The plate 160 has a pair of flat opposed parallel surfaces 162 on which the embossments 106 are formed. The plate 160 forms a square with four identical corners 151 and four mounting holes, one mounting hole 104 being arranged at each of the corners. Each of elongated slots 108 is formed parallel to one of the sides thereof. In addition, another mounting hole 104 is formed centrally of the plate 160, but formed without any embossment 106. Again, the spacing between two adjacent mounting holes with the embossments is identical to that of the flat strip 100.

FIGS. 15A, 15B, 16A, 16B, 17A and 17B show angular brackets of various configuration according to the present invention. Each of the angular brackets 170, 180 and 190 has substantially flat outer sides 171, 181, 191 and inner sides 172, 182, 192 substantially parallel to the outer sides thereof. These elements all have a same thickness which is same as that of the straight strip 100. All of these elements also have the same mounting holes 104 and embossments 106 described above with respect to the flat members. However, the embossments 106 are only formed on the outer sides thereof. The spacing between two adjacent mounting holes in the same plane having the embossments 106 is same as that of the straight strip 100. Again, each of the angled corners 179, 189 199 joined at right angles is preferably contoured smooth or beveled to remove any sharp edge.

Figure 15A:
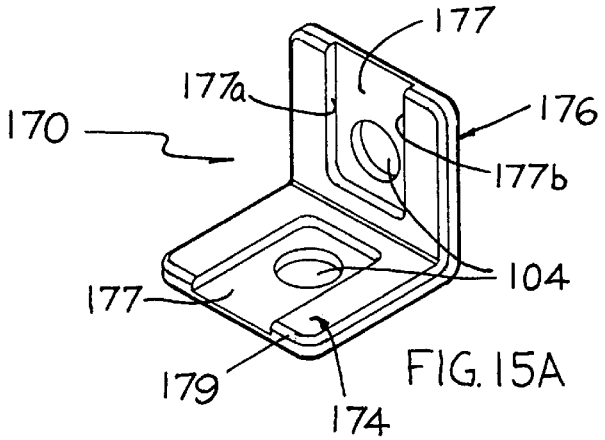
FIGS. 15A and 15B are perspective views of an angled bracket according to the present invention.
Figure 15B:
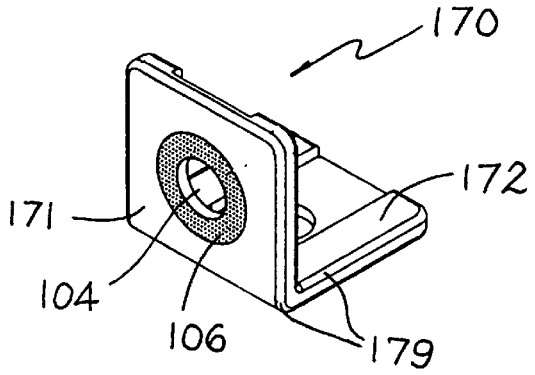

FIGS. 15A and 15B show an angular bracket 170 having a pair of legs 174 and 176 in two different perpendicular planes, joined at right angles to each other to form an L-shape. Each of the legs has at least one mounting hole 104. Each of the inner sides 172 has a longitudinal nut recess 177 extending from a free end thereof into adjacent the junction between the legs, the recess extending past the mounting hole 104. The width of the recess is dimensioned hold the nut 320 at a fixed angular position and concentric with the mounting hole 104. The opposite wall surfaces 177*a* and 177*b* formed by the recess prevent the nut 320 (FIGS. 24A and 24B) from rotating when tightening and loosening the bolt 310 that mates with the nut. Although each of the legs is shown with a single mounting hole 104, different number of mounting holes can be provided, thus varying the length thereof.

Figure 16A:
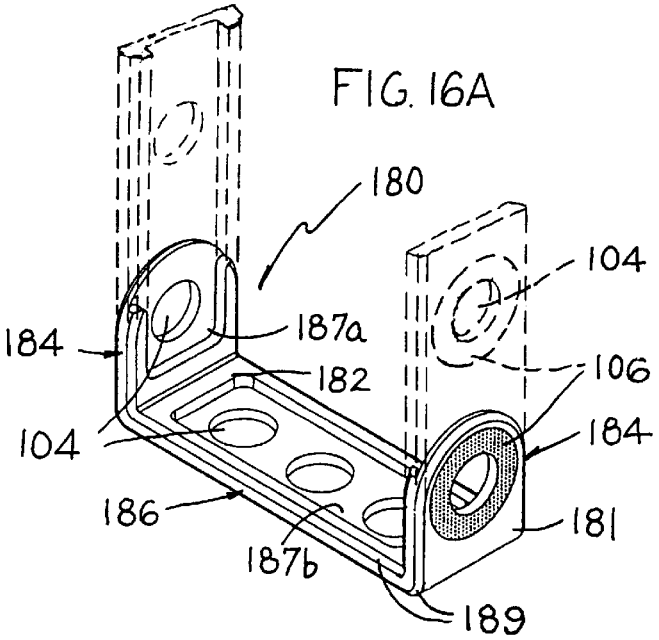
FIG. 16A is a perspective view of a double angled bracket according to the present invention.
Figure 16B:
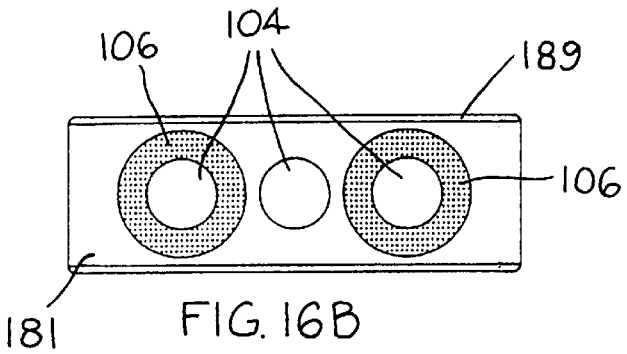
FIG. 16B is a bottom view of FIG. 16A.

FIGS. 16A and 16B show a doubled angled bracket 180 having a pair of identical legs 184 each joined to the ends of a third leg 186 to form a U-shape or C-shape. Each of the legs 184 is joined at right angles to an end of the leg 186 in a perpendicular plane. Each of the legs has at least one mounting hole 104. Each of the pair of legs 184 has a longitudinal nut recess 187a formed on the inner side thereof, which extends from a free end thereof to adjacent the junction of the legs, the recess extending past the mounting hole 104 formed nearest the junction of the legs. Again, the width of the recess is dimensioned to hold the nut 320 at a fixed angular position and concentric the mounting hole 104. The opposite wall surfaces formed by the recess prevent the nut 320 from rotating when tightening and loosening a bolt 310 that mates with the nut. The leg 186 also has a rectangular nut recess 187*b* dimensioned to hold the nut at a fixed angular position for each of the three mounting holes formed therein. Alternatively, two square recesses for the outer two holes could be formed similar to the recesses 218 formed on the block 210. The bracket 180 is provided with at least five mounting holes 104. The leg 186 is provided with a central mounting hole 104, but without an embossment on the outer side thereof, as shown in FIG. 16B. Again, the legs 184 can have different lengths as desired as shown by the phantom lines.

Figure 17A:
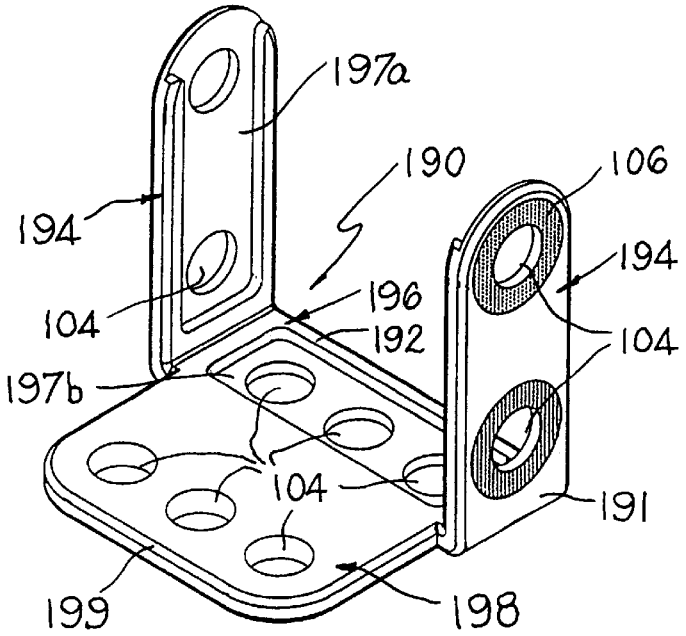
FIG. 17A is a perspective view of a flanged double angled bracket according to the present invention.
Figure 17B:
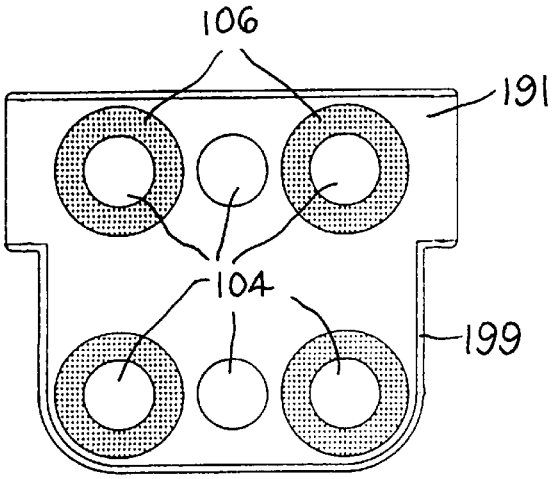
FIG. 17B is a bottom view of FIG. 17A.

The flanged double angled bracket 190 shown in FIGS. 17A and 17B are substantially similar to the double angled bracket 180. The bracket 190 has a pair of identical legs 194 joined to the ends of a third leg 196. Each of the legs has a recess 197*a*, 197*b* similar to that of the recess 187*a*, 187*b*. However, the bracket 190 is provided with a flange 198 extending from the leg 196 in the same plane. Moreover, each of the pair of identical legs 194 has two mounting holes 104, although it can also have just one mounting hole. The flange additionally has three mounting holes with a pair of embossments 106 formed on the two outer holes on the outer side thereof.

FIGS. 18A, 18B, 18C, 19A, 19B, 19C, 20A, 20B, 20C show cubical blocks 200, 210, 220 of various configuration. Each of the side walls 202, 212, 214, 222 and top walls 203, 213, 223 has at least one mounting hole 104 of the same size as that of the strip 100. A raised boss or embossment 206 substantially similar to the embossment 106 is concentrically formed around each mounting hole 104 on the outer side 201, 211, 221. The outer diameter and the thickness of the embossment 206 is same as that of the embossment 106. A circular recess 204 larger than the diameter of the mounting hole 104, but smaller than the diameter of the embossment 206 is formed concentrically with the mounting hole 104. Preferably, the diameter of the recess 204 is about one-half the diameter of the embossment 206.

Figure 18A:
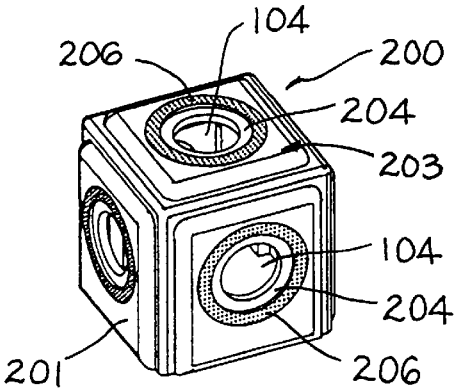
FIGS. 18A and 18B are perspective views of a cubical block according to the present invention.
Figure 18B:
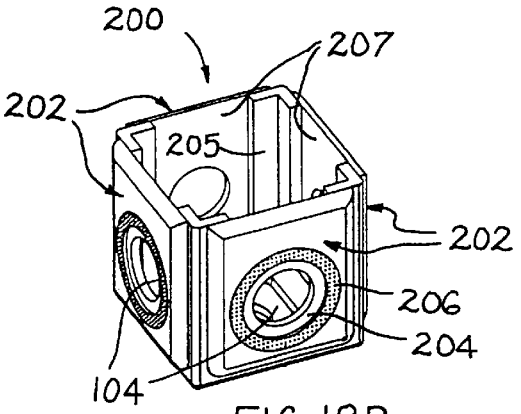
Figure 18C:
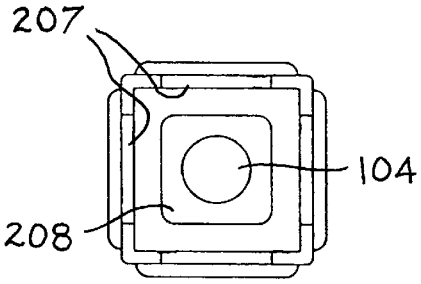
FIG. 18C is a top elevational view of FIG. 18B.

The block 200 comprises four identical side walls 202, a top wall 203 and an open bottom. As shown in FIG. 18C, each outer side 201 has a substantially planar raised surface. Each of the inner sides 205 is provided with a nut recess 207 that is substantially similar to the nut recess 177 formed on the angled bracket 170. The inner side of the top wall 203 is provided with a substantially square recess 208 so sized and shaped to receive the square nut 320. Each of the recesses 207, 208 seats the nut and prevents it from being rotated when tightening or loosening the mating bolt.

Figure 19A:
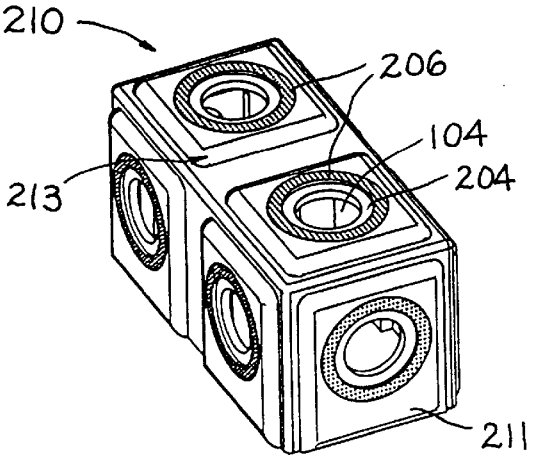
FIGS. 19A and 19B are perspective views of a double cubical block according to the present invention.
Figure 19B:
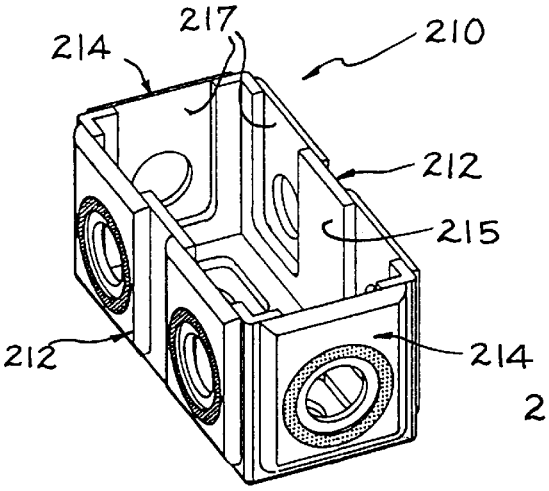
Figure 19C:
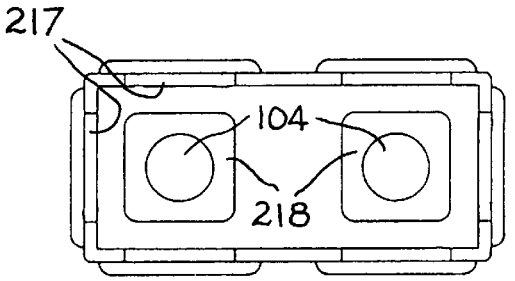
FIG. 19C is a top elevational view of FIG. 19B.

The cubical block 210 shown in FIGS. 19A and 19B in essence is two blocks 200 joined side-by-side with common side walls. The block 210 comprises a pair of identical opposed side walls 212 and another pair of identical opposed side wall 214 each of which is identical to the side wall 202 of the block 200, a top wall 213 and an open bottom. Each outer side 211 of the side walls 212 and the top wall has a pair of substantially planar raised surfaces through which a pair of mounting holes 104 are formed. Each outer side 211 of the walls 214 has a substantially planar raised surface through which one mounting hole 104 is formed. Each of the inner sides 215 of the side walls 214 is provided with a nut recess 217 in association with the mounting hole 104, substantially similar to the nut recess 207 formed on the block 200. Each of the inner sides 215 of the side walls 212 is also provided with a pair of nut recesses 217. The inner side of the top wall 213 is provided with a pair of spaced square recesses 218, each being identical to the recess 208. Alternatively, the inner side of the top wall could be provided with a single rectangular recess similar to recess 187*b* formed on the angled bracket 180. The spacing between two adjacent mounting holes 104 on the same side wall is identical to the spacing between two adjacent mounting holes 104 of the strip 100.

In addition, similar to the block 210, a block (not shown) having three or any other number of blocks 200 joined together with common opposed side walls can be provided as desired.

Figure 20A:
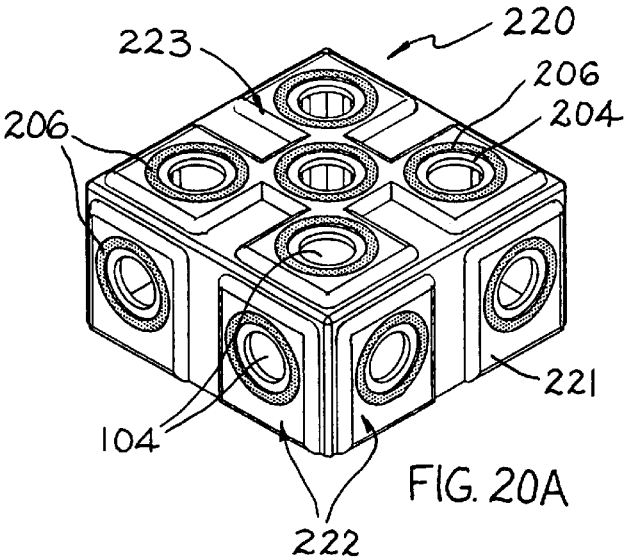
FIGS. 20A and 20B are perspective views of a rectangular block according to the present invention.
Figure 20B:
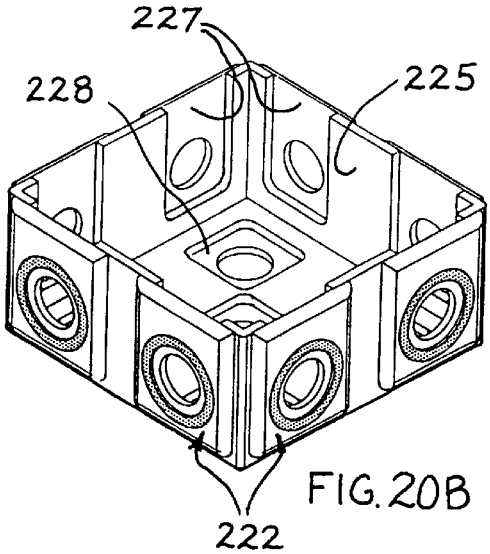
Figure 20C:
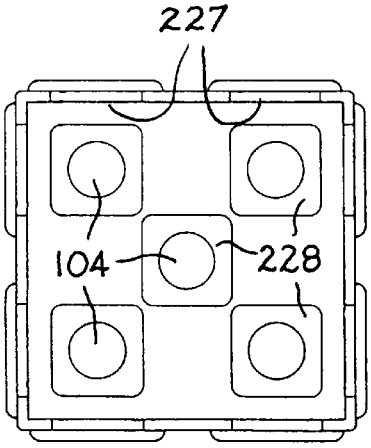
FIG. 20C is a top elevational view of FIG. 20B.

The block 220 comprises four identical side walls 222 which is similar to the side wall 212 of the block 210, a top wall 223 and an open bottom. Each outer side 221 has a substantially planar raised surface as better shown in FIG. 20A. The outer side 221 of the top wall has a five substantially planar raised surfaces through which five mounting holes 104 are formed. The raised surfaces are joined together to form an X-shaped raised surface. The inner side of the top wall 223 is provided with five square nut recesses 228 as better shown in FIG. 20C, each being identical to the recess 208. The spacing between two adjacent mounting holes 104 parallel to the side walls is identical to the spacing between two adjacent mounting holes 104 of the strip 100. FIG. 20B also includes inner sides 225, which are similar to inner sides 215, each provided with a nut recess 227, similar to nut recess 217.

FIGS. 21A, 21B, 21C, 22A, 22B, 22C, 23A, 23B, 23C, 23D show angled and curved blocks 230, 240, 250 according to the present invention. Similar to the blocks 200, 210, 220, the blocks 230, 240, 250 have walls with mounting holes 104 of the same size as that of the strip 100. A raised boss or embossment 206 and a circular recess 204 identical to that of the blocks 200, 210, 220 are concentrically formed around each mounting hole 104 on the outer side 231, 241. Moreover, nut recesses 237, 247, 257 and square nut recesses 238, 258 similar to the recesses 207 and 208 are formed on the inner sides thereof.

Specifically, the angled block 230 comprises a pair of mirror image side walls 232, a side wall 234, an angled side wall 235, a top wall 233 and an open bottom. Each outer side 221 of the walls 232 has three mounting holes 104, two of which are vertically aligned and two of which are horizontally aligned. The spacing between the horizontally and vertically aligned pairs of mounting holes is same as the spacing between two adjacent mounting holes 104 of the strip 100. The outer side of the top wall has four planar raised surfaces through which four mounting holes 104 are formed therewithin. The outer side of the side wall 234 has two planar raised surfaces through which four mounting holes 104 are formed, two on each thereof. Each of the side walls 232 has one sloped edge 232a on which the side wall 235 is formed.

Figure 21A:
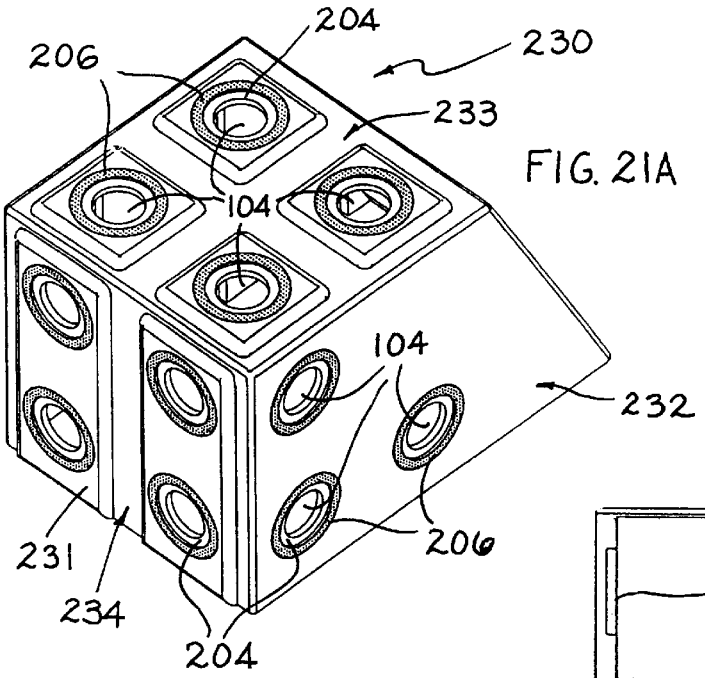
FIGS. 21A and 21B are perspective views of an angled block according to the present invention.
Figure 21C:
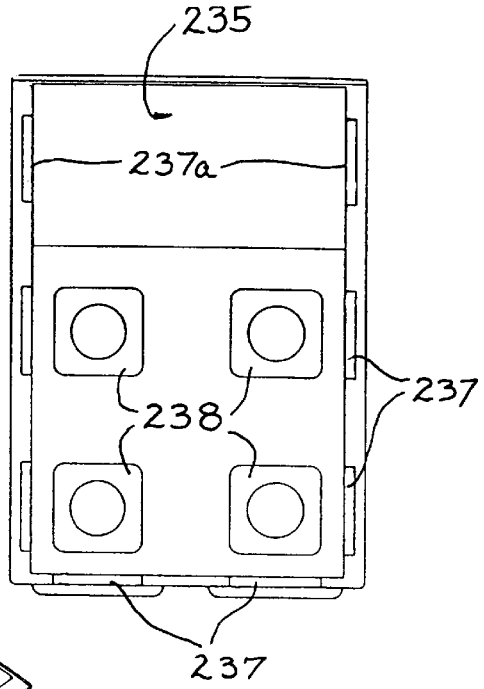
FIG. 21C is a top elevational view of FIG. 21B.
Figure 21B:
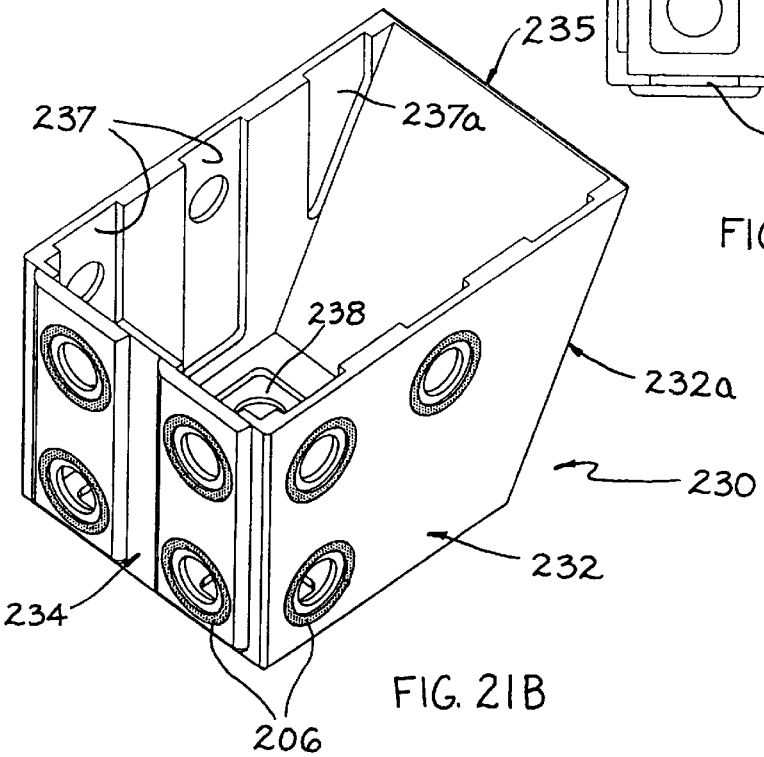

As shown in FIGS. 21B and 21C, each of the inner side of the side walls 232, 234 is provided with two vertical nut recesses 237 similar to the nut recess 207 except that the length of the recesses 237 accommodates at least two nuts. In addition, each of the side walls 232 has another recess 237*a*. The inner side of the top wall 233 has four square nut recesses 238, each identical to the recess 208. The spacing between two adjacent mounting holes 104 parallel to the side walls is identical to the spacing between two adjacent mounting holes 104 of the strip 100.

The curved block 240 comprises a pair of mirror imaged side walls 242, a third side wall 244, a curved top/side wall 243 and an open bottom. Each of the side walls 232 has three mounting holes 104 spaced and arranged identically to the three mounting holes 104 formed on the side walls 232 of the angled block 230. The side wall 244 is substantially identically to the side wall 234 of the angled block, except that the side wall 244 has two additional vertically spaced mounting holes 104 formed through another planar raised surface. Each of the side walls 242 has one curved edge 242a on which the top/side wall 243 is formed.

Figure 22A:
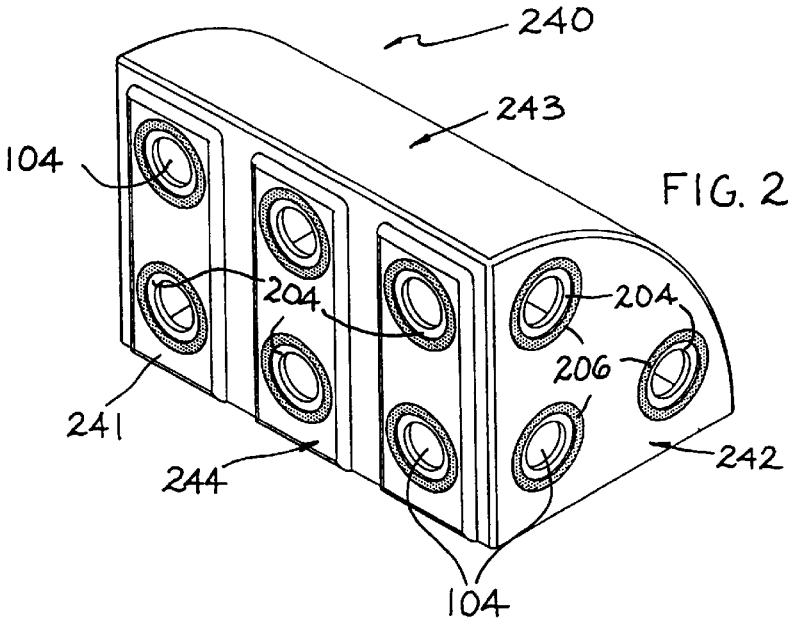
FIGS. 22A and 22B are perspective views of a curved block according to the present invention.
Figure 22B:
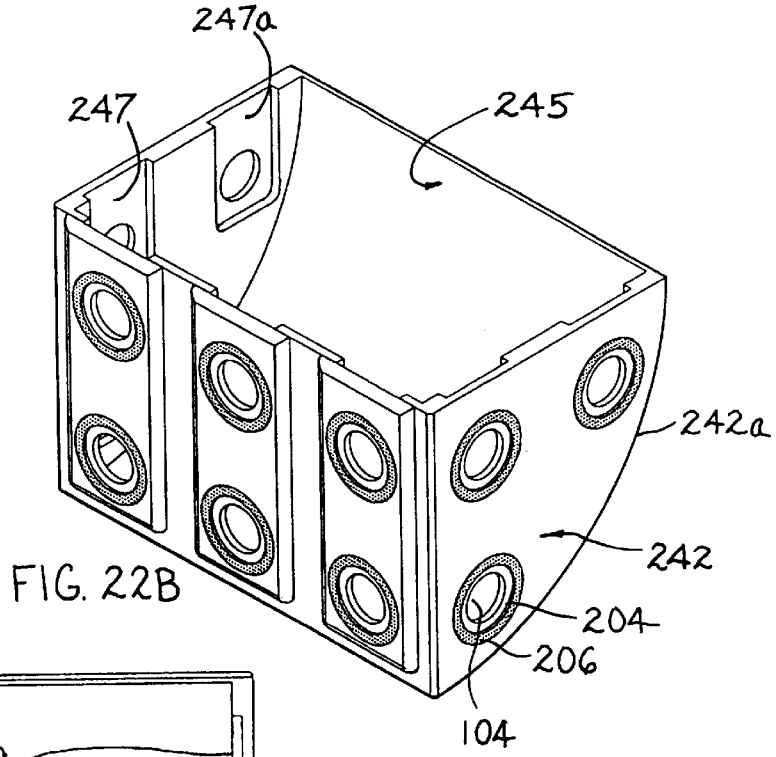
Figure 22C:
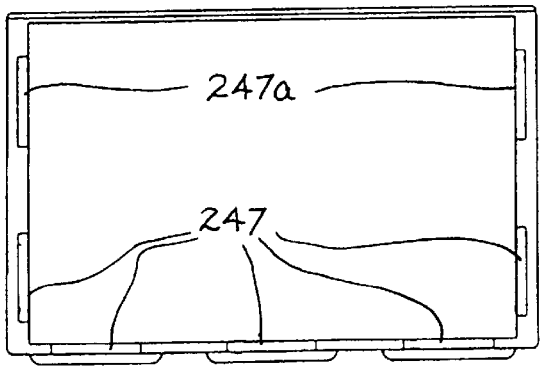
FIG. 22C is a top elevational view of FIG. 22B.

As shown in FIGS. 22B and 22C, each of the inner side of the side walls 242, 244 is provided with two vertical nut recesses 247 similar to the nut recess 237. Specifically, inner side of the side wall 244 has three recesses 247 each for accommodating two nuts. The inner side of the each side wall 242 has one recess 247 for accommodating two nuts and one recess 247*a* for accommodating one nut. The spacing between two adjacent mounting holes 104 parallel to the side walls is identical to the spacing between two adjacent mounting holes 104 of the strip 100.

Figure 23A:
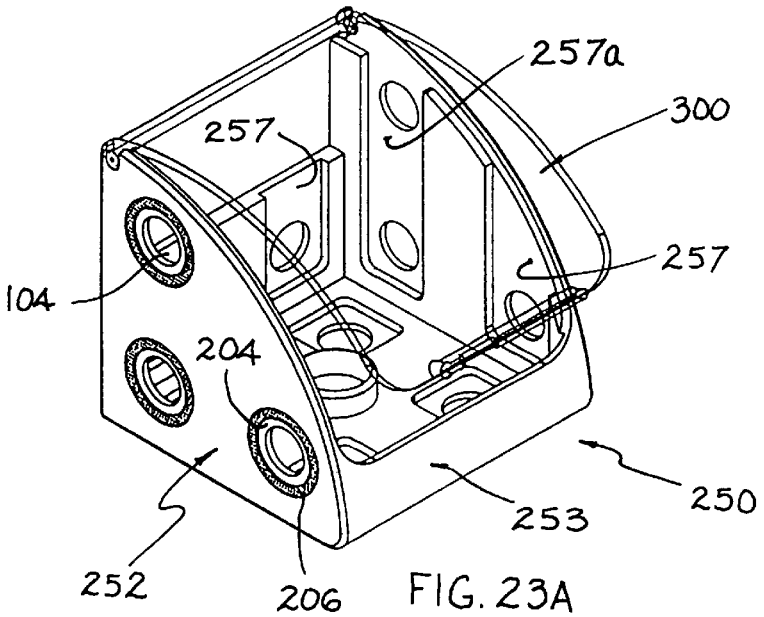
FIG. 23A is a perspective view of a curved cabin block according to the present invention with a windshield in a partially opened position.
Figure 23B:
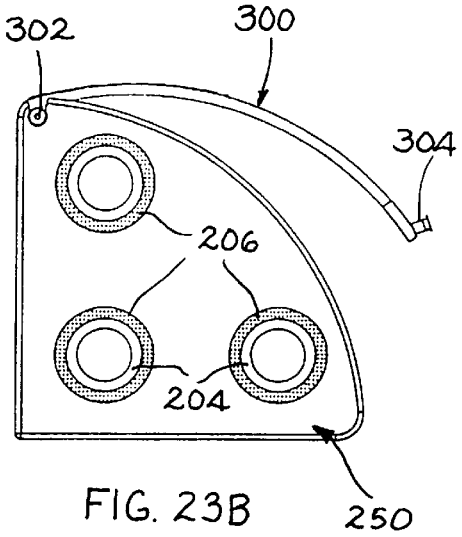
FIG. 23B is a side view of FIG. 23A with the windshield in a partially opened position.
Figure 23D:
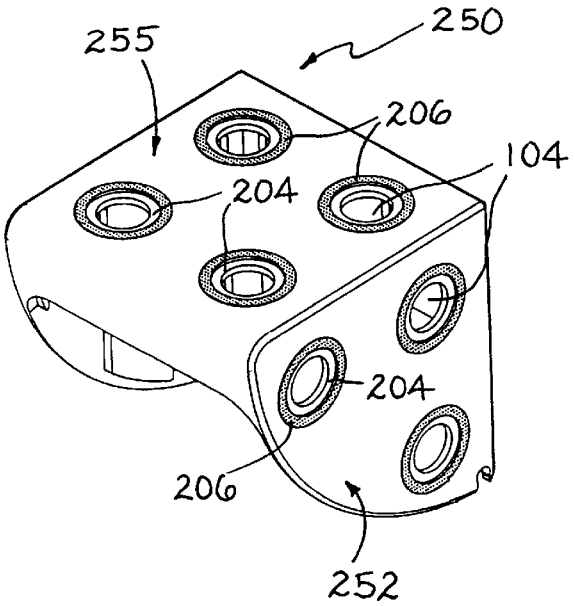
FIGS. 23C and 23D are perspective views of the curved cabin block with the windshield detached.
Figure 23C:
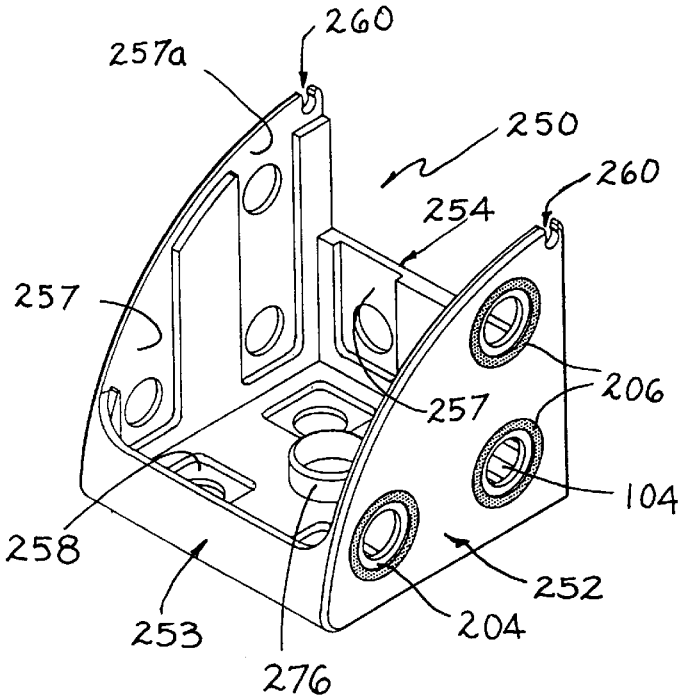
Figure 24A:
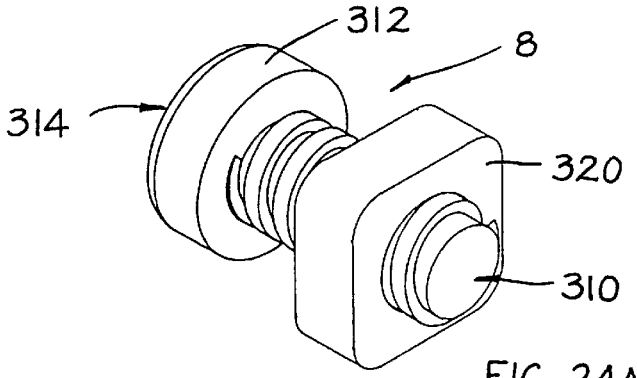
FIG. 24A is a fastener comprising a bolt and a nut according to the present invention.
Figure 24B:
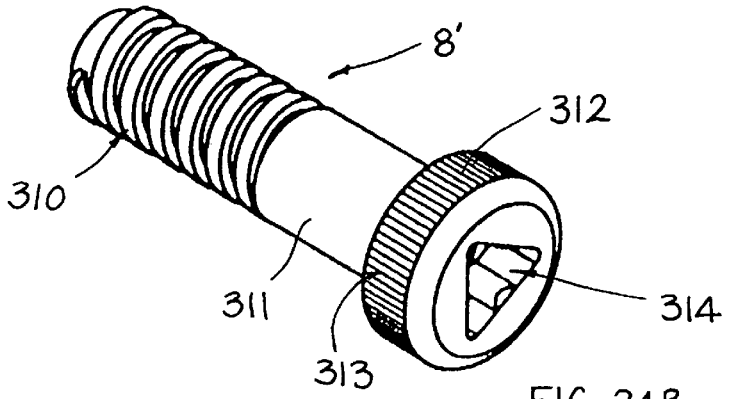
FIG. 24B is a variation of the bolt shown in FIG. 24A.

FIGS. 23A and 23B show a curved cabin block 250 with a windshield 300 connected in a partially opened position according to the present invention. FIGS. 23C and 23D show the curved cabin block 250 with the windshield removed. The cabin block 250 comprises a pair of opposed mirror image side walls 252, a rear wall 254, a curved front wall portion 253, a bottom wall 255 and an open top/side. Each of the side walls 252 has three mounting holes 104 spaced and arranged identical to the three mounting holes 104 formed on the side walls 232 of the blocks 230 and 240. The rear wall 254 has two horizontally spaced mounting holes 104, which is substantially identically to the side wall 222 of the block 200 except that there is no raised planar surfaces other than the embossments formed around each mounting hole 104. The bottom wall 255 is provided with four mounting holes 104 similar to the top wall 233 of the block 230, but without the raised planar surfaces. Each of the side walls 252 has one curved edge 242*a* on which the side wall 253 is formed.

As shown in FIGS. 23A and 23C, each of the inner side of the side walls 252, 254 is provided with two vertical nut recesses 257, 257*a*. Specifically, the inner side of the side wall 254 has two recesses 257 each for accommodating one nut. The inner side of each side wall 252 has one recess 257 for accommodating one nut and one recess 257*a* for accommodating two nuts. The inner side of the bottom wall 255 has four square nut recesses 258 identical to the recesses 238 of the block 230. The spacing between two adjacent mounting holes 104 parallel to the side walls is identical to the spacing between two adjacent mounting holes 104 of the strip 100.

An upwardly extending cylindrical collar 276 is formed centrally of the bottom wall. The collar 276 cooperates with the recess 68 formed on the body 61 of the hand tool 10. Similar to the collar 76 formed on the handle 70, the collar 276 is so dimensioned to frictionally engage the recess 68 such that the cap can be attached to the bottom wall of the cabin block 250. Each upper side corner of the side walls 252 has a slot 260 to permit a rotatable connection with the windshield. The slot 260 preferably has a smaller opening at its entrance and enlarges toward its end to permit a snap fit of the windshield. The windshield is provided with a pair of outwardly and laterally extending pins 302 which engage the slots 260, and a handle 304 to permit fingers to grab and lift the windshield. The curvature of the windshield is substantially identical to the curvature of the curved free ends of the side walls 252 such that the windshield can fully close even with the cap 60 connected to the cabin block. Moreover, the edges 261 and 262 formed on the inner side of the walls 252 act as limit stops to prevent the windshield from closing too far inwardly. That is, the edges 261 and 262 align the windshield such that it is substantially flush with the curved free edges of the walls 252 when the windshield is fully closed.

Figure 33A:
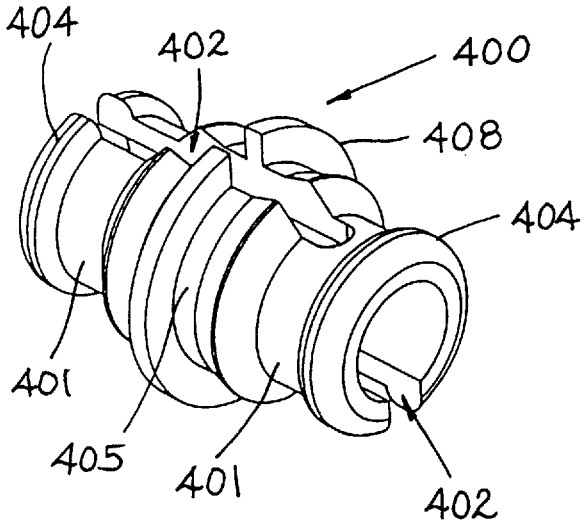
FIG. 33A is a perspective view of a locking pin connector according to the present invention.
Figure 33B:
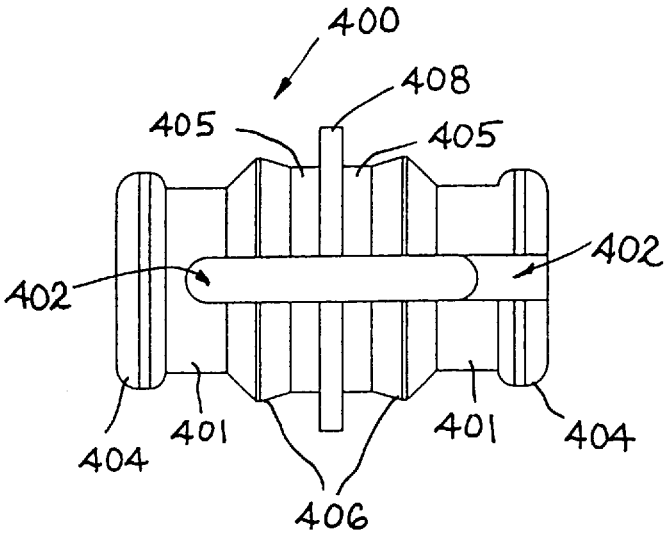
FIG. 33B is a bottom elevational view of FIG. 33A, the top elevational view thereof being identical but mirror image of the bottom view.

FIGS. 33A and 33B show a locking pin connector 400 which snap fits in the mounting holes 104 formed concentric with the circular recess 204 in the blocks 200, 210, 220, 230, 240, 250 to connect them together. Specifically, the connector 400 comprises an elongated hollow tube of a uniform inside diameter and varying outer diameters. The cylinder has a pair of diametrically opposed slots 402 extending along its wall in the axial or longitudinal direction thereof. Each of the slots extends from its free end toward the opposite end, the length thereof being greater than about three-quarter of the total length of the cylinder, one slot extending from one end toward the other end and the other slot extending from the other end toward the one end.

The first cylinder portion 401 have a dimension smaller than the diameter of the mounting hole 104. Each end has a circular ridge 404 of a greater dimension than the cylinder portion 401, but still smaller than the diameter of the mounting hole 104. The second cylinder portion 405 has a dimension substantially equal to or slightly less than the diameter of the mounting hole 104 to permit a relative rotatable connection therewith. A central circular flange 408 is disposed between the cylinder portion 405. The outer diameter of the flange 408 is substantially equal to or slightly less than the circular recess 204. The thickness of the flange 408 is substantially is greater than but no more than the twice the depth of the recess 204 such that the flange is completely between two recesses 204 when the blocks are connected therewith.

Between each of the cylinder portions 401 and the flange 408, a second circular ridge 406 having a slightly larger diameter than the mounting hole 104 is formed. The pin connector snap fits into the mounting hole 104 provided with a circular recess 204, the ridge 406 providing a locking mechanism. The length of each of the portions 405 in the axial direction thereof or the spacing between the flange 408 and each of the ridges 406 is about the thickness of the wall of the block at the area of the circular recess to permit the connection pin to snap fit into the mounting hole. The slots enable the ridge 406 to squeeze through the mounting hole 104 when the pin connector is pushed with a sufficient force, and returns to its normal dimension once the ridge passes therethrough. Each pin connector enables any two blocks to be connected together. Specifically, a pin connector is first connected to one of the two blocks from one end and then another block to be connected is connected through the other end of the pin connector. To disconnect the blocks, the blocks are pulled apart and then the connector is pulled out from the block in which the connector remains attached to.

FIGS. 24A and 24B show fasteners 8 and 8' according to the present invention. The fasteners 8 and 8' each comprise a threaded bolt 310 and a square nut 320. The bolt preferably has an Acme screw threading to permit faster nut travel with each turn of the bolt. The bolt 8 has a completely threaded shank whereas the bolt 8' has a partially threaded shank. The non-threaded portion 311 can be used as bearing surface in which parts can be rotatably mounted. Each of the bolts 8, 8' further has a head 312 preferably with a triangular recess 314 which is complementary to the driver members 42 and 52. The head 312 shown in FIG. 24B has a plurality of axially extending grooves 313 which provide a textured gripping surface to enhance friction. Specifically, the bolt can be turned also by grabbing the textured surface of the head. The bolt 310 shown in FIG. 24A also preferably has such textured gripping surface formed on the perimeter of the head 312.

The diameter of the head 312 is such that it cooperates with the recess 68 formed in the cap 60 to frictionally engage therewith. The diameter of the nut is about the width or slightly smaller than the width of the recesses 177, 187, 207, 208, 217, 218, 227, 228, 237, 238, 247, 257, 258, the width thereof being uniform. The nut 320 is substantially square with rounded corners which fit within the recesses. The bolt and the nut are preferably formed of conventional plastic material such as polypropylene, ABS or nylon. However, it is preferable to form them with polypropylene, more preferably with 5% fiber glass for strength.

Figure 25A:
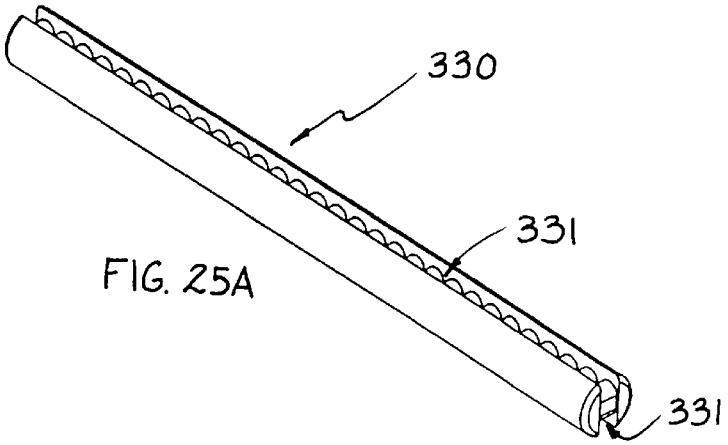
FIG. 25A is a perspective view of an axle rod according to the present invention.
Figure 25B:
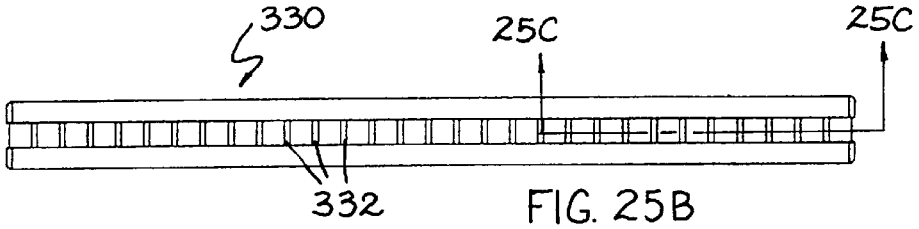
FIG. 25B is a top elevational view of FIG. 25A.
Figure 25C:
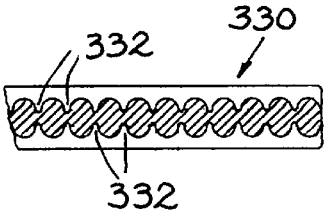
FIG. 25C is a partial cross-sectional view taken along line 25C—25C of FIG. 25B.

FIGS. 25A, 25B and 25C show an axle rod 330 according to the present invention. The axle rod is substantially circular with a pair of opposed mirror image longitudinal channels 331 formed therein. A pair of opposed mirror image rows of evenly spaced curved notches 332 are formed in the channel along the longitudinal or axial direction thereof. The axle rod is substantially circular to permit a rotatable connection with any of the above described elements having a mounting hole 104, wheel 500, pulley 520, spacer 530, and washer 540 shown in FIGS. 26A and 26B, 28, 29 and 30.

Figure 31A:
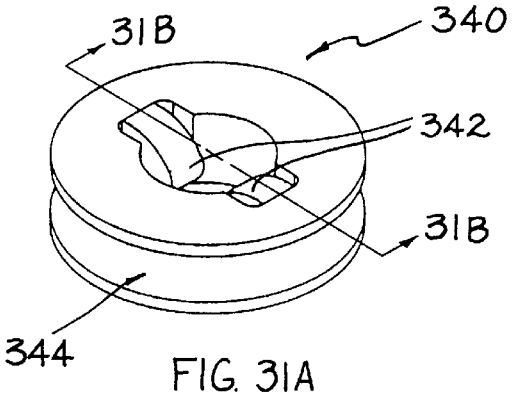
FIG. 31A is a perspective view of a locking clip according to the present invention.
Figure 31B:
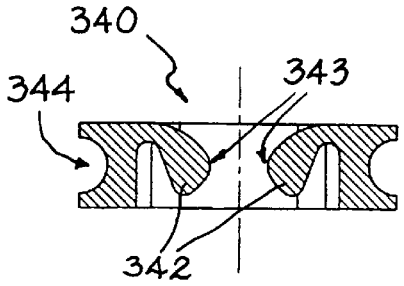
FIG. 31B is a cross-sectional view taken along line 31B—31B of FIG. 31A.

The axle rod cooperates with a locking clip 340 shown in FIGS. 31A and 31B. The locking clip has a cylindrical or circular configuration with a central opening configured to the cross sectional geometric configuration of the axle rod. The central opening permits the locking clip to move longitudinally of the axle rod but does not permit relative rotational movement therewith. Specifically, it has a mechanical locking mechanism comprising a pair of opposed mirror image tabs 342 formed on the central opening. The tabs occupy the space formed in the channels to thereby prevent a rotational movement about the axle rod.

Each tab has a rounded apex 343 forming the narrowest spacing therebetween. The tabs are resiliently hinged so that they can flex in the radial direction. The tabs cooperate with the notches 332 to provide a positive lock along any of the notches to maintain any attached wheel and/or pulley from axially moving. Specifically, the peaks and valleys of the notches cooperate with the apexes of the tabs to frictionally interlock the locking clip at a desired position relative to the axle rod. When the clip is at a locking position, the apexes rest adjacent the valleys or the notches. To move the locking clip longitudinally, some force is necessary to cause the tabs to expand radially. This is achieved by pulling or pushing the clip along the axial direction of the axle rod. When a sufficient force is applied, the curved notches acts as a cam against the curved apexes to radially move the resiliently hinged tabs over the peaks and down to the next valley. Continuous push or pull causes the clip to successively move relative to the axle rod in the axial direction.

Moreover, the outer perimeter of the locking clip has a groove 344 for engaging a belt or the like. The locking clip has another function as a driving pulley. The outer perimeter thereof can also have teeth or like to positively rotate a belt with cooperating teeth or the like.

Figure 32A:
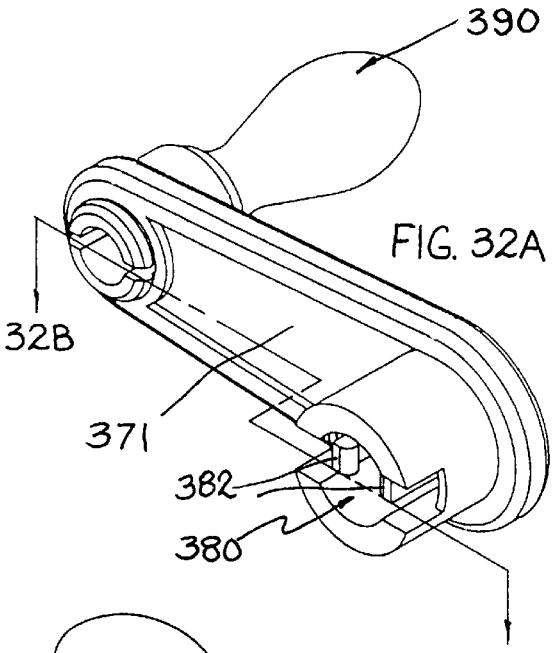
FIG. 32A is a perspective view of a crank according to the present invention.
Figure 32B:
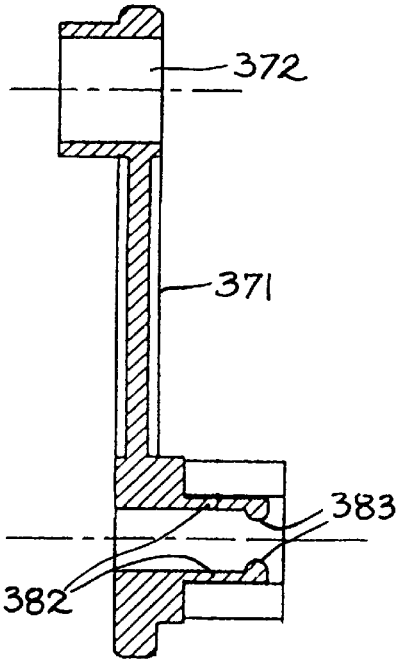
FIG. 32B is a cross-sectional view taken along line 32B—32B of FIG. 32A with the handle thereof detached.

FIGS. 32A and 32B show a crank 370 comprising an elongated body 371 having a locking mechanism 380 substantially similar to the locking mechanism of the locking clip formed at one end of the body. Specifically, the locking mechanism 380 has a pair of mirror image opposed tabs 382 that cooperate with the notches 332 formed on the axle rod 330 to interlock the crank. Similar to the tabs 342 of the locking clip, the tabs 382 occupy the channels 331 to prevent relative rotational movement between the axle rod and the crank.

Each tab 382 has a rounded apex 383 forming the narrowest spacing therebetween. The tabs are resiliently hinged so that they can flex in the radial direction. The tabs cooperate with the notches 332 to provide a positive lock described above with respect to the locking clip.

Figure 32C:
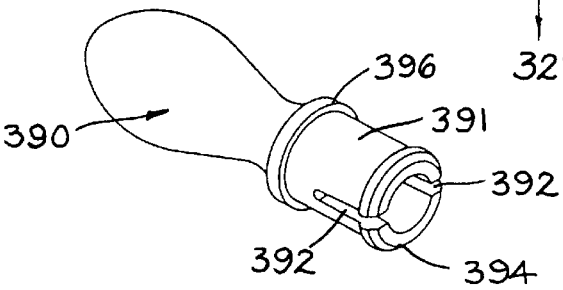
FIG. 32C is a perspective view of the handle of FIG. 32A.

The crank has a handle 390 that snap fits into the hole 372 formed at the other end of the crank. As better shown in FIG. 32C, the handle has a bearing portion 391 having a diameter slightly less than or substantially the same diameter as the hole 372. A pair of diametrically opposed slots 392 are formed on the bearing portion to enable it to be squeezed during insertion through the hole 372. The bearing portion is provided with a chamfered circular ridge 394 and a limit stop ridge 396. Each of the ridges has a diameter larger than the hole 372. The slots permit the diameter of the ridge to be squeezed during insertion into the body, but returned to its normal dimension once the ridge passes through the hole. The slots, however, permit removal of the handle from the body when pulled with enough force.

Figure 26A:
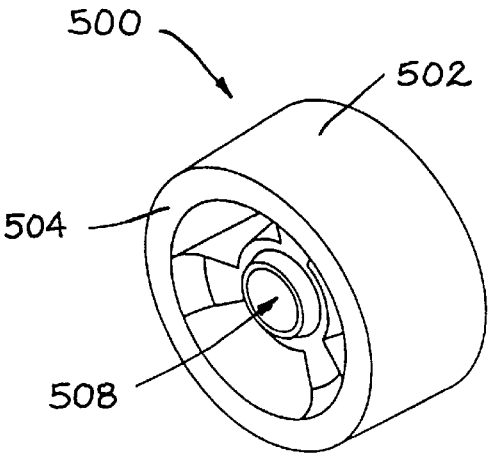
FIGS. 26A and 26B are perspective views of a wheel according to the present invention.
Figure 26B:
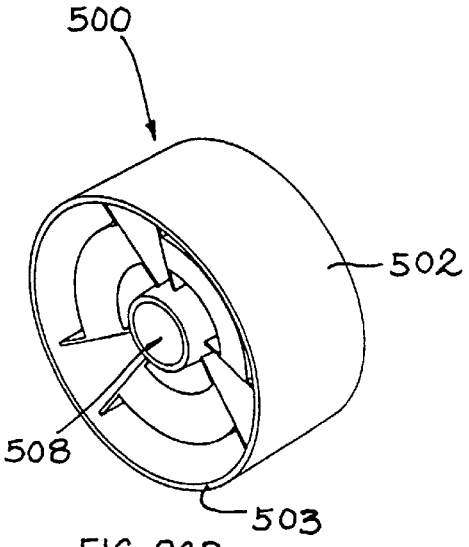

FIGS. 26A and 26B show a wheel 500 according to the present invention which can be used in conjunction with the axle rod 330, the locking clip 340, the spacer 530, etc. The wheel comprises a cylindrical outer side 502 which is slightly conical and a central opening 508 having a diameter equal to that of the mounting hole 104. The outer side 502 tapers slightly outwardly from the outer face side toward the inner face side of the wheel as shown in the FIGS. 26A.

FIG. 26A shows the outer sidewall 504 which extends from the perimeter end of the outer side 502. FIGS. 26B shows the inner face 503 of the wheel which has no side wall extending from the edge of the outer side 502.

Figure 27A:
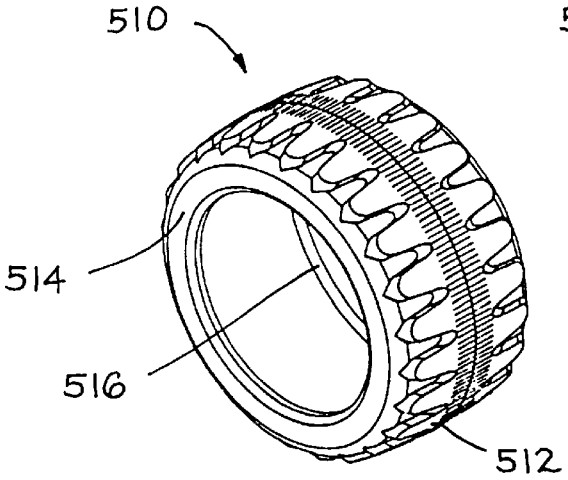
FIGS. 27A and 27B are perspective views of a tire according to the present invention.
Figure 27B:
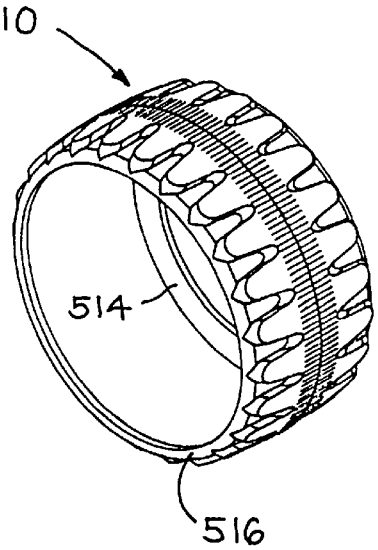

FIGS. 27A and 27B show a tire 510 according to the present invention. The tire is formed of a resilient material such as plastics and rubber having an inner diameter about the diameter of the outer surface 502 at the junction with the outer face 501. In other words, the inner diameter of the tire has a size of the smallest outer diameter of the wheel. This enables the tire to be stretched over the wheel and frictional held with substantially no relative rotational movement therebetween.

FIG. 27A shows the outer sidewall 514 of the tire which extends from the tread portion 512. The sidewall 514 extends toward the center thereof to cover the sidewall 504 of the wheel. FIG. 27B shows the inner sidewall 516 extending from the tread portion. The sidewall 516 extends toward its center to cover the edge 505 of the inner side of the wheel. According to the present invention, different tires can be fitted over the wheel. The tires can be substituted for tires having different treads.

Figure 28:
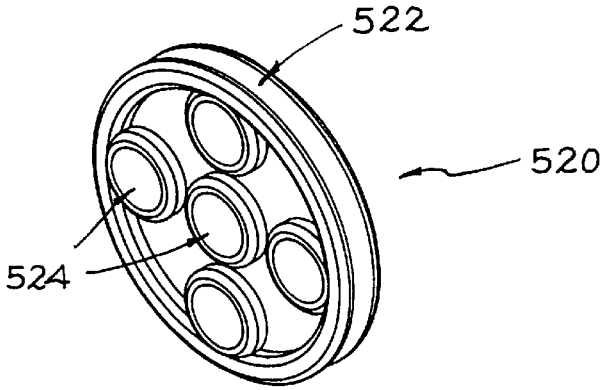
FIG. 28 is a perspective view of a pulley according to the present invention.

FIG. 28 shows a pulley 520 having an groove 522 formed at its outer perimeter similar to the groove 344 formed at the locking clip 340. The pulley has at least a central hole 524 of the same diameter as the mounting hole 104. The pulley can be used in conjunction with the bolt 310 or the axle rod 340 for a rotatable support. Preferably, the pulley has four additional holes 524 of the same diameter as the mounting hole 104. These additional holes can be used to connect additional elements such as another pulley.

Figure 29:
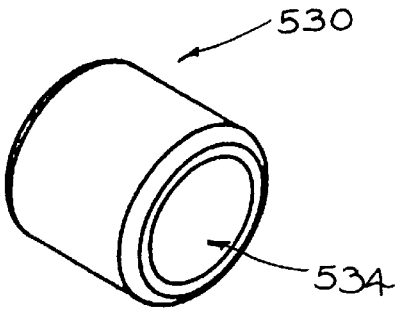
FIG. 29 is a perspective view of a spacer according to the present invention.

FIG. 29 shows a spacer 530 having a central hole 534 of the same diameter as the mounting hole 104. The spacer can be used in conjunction with the bolt 310 or the axle rod 340 to provide a spacing between a wheel and the locking clip for instance.

Figure 30:
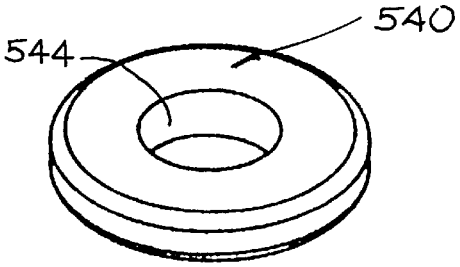
FIG. 30 is a perspective view of a washer according to the present invention.

FIG. 30 shows a washer 540 having a central hole 544 of the same diameter as the mounting hole 104. The washer can be used either as a smaller spacer or with the bolt to provide a spacing between the element and the bolt head. The washer is preferably made of soft elastic material such as rubber and plastics.

It will be understood by one skill in the art from the present disclosure that a number of construction and fastener elements can be combined to form the kit. Also, depending upon the number of same and different components of the kit, structures of infinite variety can be constructed such as air planes, automobiles, boats and ships, cranes, helicopters, trucks etc. In this regard, the following MECCANO ERECTOR instructional booklets published by MECCANO are available from MECCANO, S. A., 363 Avenue de Saint Exupery, 62100 Calais, FRANCE : Junior Model, Junior Model 1310, Junior Model 1315, Junior Model 1320, Junior Model 1350, Junior Model 1355, Junior Model 1530 and Junior Model 1540. These instructional booklets provide some of the structures that can be created using the construction kit according to the present invention. Also, different kits can be combined to achieve larger or more complex structures.

Moreover, it would be understood that the kit according to the present can include other accessories for the construction elements that are specifically not specifically shown such as hooks, belts, other tools such as pliers and wrench.

It would also be apparent to one skilled in the art that the above disclosed construction elements can be molded from any suitable durable material such as plastics, particularly ABS, polypropylene, nylon, etc.

The foregoing description is only illustrative of the principle of the present invention. It is to be recognized and understood that the invention is not to be limited to the exact configuration as illustrated and described herein. Accordingly, all expedient modifications readily attainable by one versed in the art from the disclosure set forth herein that are within the scope and spirit of the present invention are to be included as further embodiments of the present invention. The scope of the present invention accordingly is to be limited to as set forth in the appended claims.

What is claimed is:

1. A construction toy kit component comprising a block having at least four walls with an inner side and an outer side, and an opening to access said inner side of said walls, wherein two opposed side walls are joined by a bottom wall, a back wall and a front wall, said front wall extending upwardly partially and leaving a substantially open front wall, each of said side, back, and bottom walls having at least two mounting holes with a circular embossment formed concentrically around each said mounting hole on said outer side.

2. The construction toy kit component of claim 1 further comprising:

a plurality of plastic construction elements and fasteners for connecting said elements, with at least one of said fasteners including a nut having at least one planar edge and a bolt having a threaded shank and a head, and at least one of said construction elements comprising a pair of substantially parallel opposed surfaces and at least two sides, at least two spaced mounting holes, an elongated slot formed between said holes, and an integrally molded embossment formed as a concentric circle around each of said mounting holes on at least one of said opposed surfaces, wherein said mounting holes are adapted to receive said fasteners to hold said elements together, said embossment has a textured surface which provides resistance to movement when connected to another construction element but which allows rotation when said embossments are in contact due to forces from said fasteners, and at least one of said construction elements includes a recess having at least one planar edge for contacting the planar edge of one of said nuts to thereby substantially preclude rotation of said nut in the recess as the nut engages the shank of said bolt to connect the construction element to another element.

3. A construction toy kit according to claim 2, wherein said embossment is circular and is formed on each of said opposed surfaces, wherein said elongated slot extends substantially parallel to one of said sides.

4. A construction toy kit according to claim 3, wherein one element includes at least one flat elongated strip having two parallel longitudinal sides, wherein said at least two spaced mounting holes are aligned parallel to said longitudinal sides.

5. A construction toy kit according to claim 4, wherein one element includes at least one flat angled strip, said angled strip having at least a pair of elongated leg strips joined at an angle, one of said mounting holes being formed at the vertex of said leg strips, each of said leg strips being substantially similar to said flat elongated strip.

6. A construction toy kit according to claim 5, wherein said leg strips are joined at right angles.

7. A construction toy kit according to claim 6, wherein said flat angled strip forms one of an A-shape, a C-shape, an L-shape or a T-shape.

8. A construction toy kit according to claim 6, wherein said flat angled strip has a third leg strip joined at right angles to a free end of one of said two leg strips.

9. A construction toy kit according to claim 3, wherein one element includes a plate having at least three sides.

10. A construction toy kit according to claim 9, wherein said plate is triangular and has at least three of said mounting holes, one formed at each of the vertexes thereof and at least three of said elongated slots, each of said slots formed between two adjacent holes which are parallel to one of said three sides.

11. A construction toy kit according to claim 10, wherein each slot is parallel to an imaginary line extending through centers of said two adjacent holes.

12. A construction toy kit according to claim 11, wherein said plate forms an equilateral triangle.

13. A construction toy kit according to claim 9, wherein said plate forms a polygon, with said mounting holes formed at each of the vertexes thereof and said slots formed between two adjacent holes, each of said slots being parallel to an imaginary line extending through centers of two adjacent holes.

14. A construction toy kit according to claim 9, wherein said plate forms an equilateral polygon.

15. A construction toy kit according to claim 14, wherein said plate is a square.

16. A construction toy kit according to claim 2, wherein one element includes at least one angular bracket, said angular bracket comprising a pair of legs wherein each lea has a free end and an end joined at right angles to form an L-shape, said bracket having an outer side and an inner sire substantially parallel to said outer side, at least one of said mounting holes formed on each leg, a circular embossment formed concentrically around each said mounting hole on said outer side.

17. A construction toy kit according to claim 2, wherein one element includes at least one angular bracket, said angular bracket comprising three angled legs, a pair thereof each having an end joined to both ends of a third leg at right angles to form a U-shape and a free end, said bracket having an outer side and an inner side substantially parallel to said outer side, at least one of said mounting holes formed on each of said pair of legs and at least two of said mounting holes formed on said third leg, a circular embossment formed concentric around each of said mounting holes on said outer side.

18. A construction toy kit according to claim 17, wherein said angular bracket element further comprises a recess formed on said inner side of each of said pair of legs, each said recess extending from a free end thereof toward the junction of said third leg, said recess being sized to seat said fastener.

19. A construction toy kit according to claim 18, wherein said angular bracket element further comprises at least one polygonal recess formed on said inner side of said third leg, said polygonal recess being sized to receive at least one fastener.

20. A construction toy kit according to claim 19, wherein said third leg has a flange extending perpendicular to said pair of legs, said flange having at least two spaced mounting holes and a circular embossment formed concentric around each mounting hole on said outer side.

21. A construction toy kit according to claim 2, wherein one element includes at least one block having at least four walls with an inner side and an outer side, and an opening to access said inner side of said walls, at least three of said side walls each having at least one of said mounting holes with a circular embossment formed concentrically around said mounting hole on said outer side, and a circular recess having a larger diameter than said mounting hole, but smaller diameter than said embossment formed on said outer side of each of said hole.

22. A construction toy kit according to claim 21, wherein each mounting hole of said element has an associated recess on said inner side for seating said fastener.

23. A construction toy kit according to claim 22, wherein said block forms a cube having four side walls, a top wall, and an open bottom, each of said four side walls and said top wall having said mounting hole.

24. A construction toy kit according to claim 22, wherein said block has four side walls, a top wall, and an open bottom, and a pair of opposed side walls of said four side walls and said top wall each having at least two mounting holes.

25. A construction toy kit according to claim 22, wherein said block has four side walls, a top wall, and an open bottom, said four side walls and said top wall each having at least two mounting holes.

26. A construction toy kit according to claim 25, wherein said top wall has five mounting holes.

27. A construction toy kit according to claim 22, wherein said block has four side walls, a top wall, and an open bottom, three of said four side walls and said top wall each having at least two mounting holes.

28. A construction toy kit according to claim 22, wherein said block has four side walls and an open bottom, one of said side walls being curved, the other three side walls each having at least three mounting holes.

29. A construction toy kit according to claim 1, wherein said front wall is curved.

30. A construction toy kit according to claim 29, further comprising a windshield pivotally and removably connected to said block, said windshield covering said substantially open front wall.

31. A construction toy kit according to claim 29, further comprising a collar extending upwardly from said bottom wall.

32. A construction toy kit according to claim 31, wherein said collar is circular and is formed at the center of said bottom wall.

33. A construction toy kit according to claim 2, further comprising a hand tool for use with said fasteners, said tool comprising:

a handle having an upper end and a lower end;

a shank extending from said upper end; and a driver member formed on a free end of said shank.

34. A construction toy kit according to claim 2, wherein one fastener is a nut and a bolt comprising a threaded shank and an enlarged head, wherein at least one of said holes is dimensioned to receive said threaded shank.

35. A construction toy kit according to claim 2, wherein at least one of said fasteners comprises a cylinder having a circumference, a diameter, at least two circular ridges, two ends, and a slot disposed at least partially along the cylinder substantially perpendicular to each end of the cylinder, wherein at least one circular ridge is disposed adjacent at least one end of the cylinder and having a diameter greater than the diameter of the cylinder, and said circumference may be decreased to position the fastener in said mounting holes of said construction elements, wherein, after positioning, the circumference of said fastener resiliently returns to its original configuration.

36. A construction toy kit according to claim 2, wherein at least one of said fasteners has a head which includes a triangular recess for receiving a tool having a correspondingly shaped shank.

37. The construction toy kit according to claim 1, further comprising at least one fastener having a planar edge and a recess associated with each mounting hole on the inner side of said block, said recess having at least one planar edge for contacting at least one corresponding planar edge of one of said fasteners to thereby resist rotation of said fastener.

38. The construction toy kit component of claim 1, further comprising a plastic component sized to cover at least a portion of the substantially open front wall.

39. The construction toy kit component of claim 38, wherein the plastic component is releasably attached to the block.

40. A construction toy kit adapted for constructing various forms of structures comprising:

a plurality of plastic construction elements and fasteners for connecting said elements, with at least one of said fasteners including a nut having at least one planar edge and a bolt having a threaded shank and a head, and at least one of said construction elements comprising a pair of substantially parallel opposed surfaces and at least two sides, at least two spaced mounting holes, an elongated slot formed between said holes, and an integrally molded embossment formed as a concentric circle around each of said mounting holes on at least one of said opposed surfaces, wherein said mounting holes are adapted to receive said fasteners to hold said elements together, said embossment has a textured surface which provides resistance to movement when connected to another construction element but which allows rotation when said embossments are in contact due to forces from said fasteners, and at least one of said construction elements includes a recess having at least one planar edge for contacting the planar edge of one of said nuts to thereby substantially preclude rotation of said nut in the recess as the nut engages the shank of said bolt to connect the construction element to another element; and a base platform, said platform having a planar base with a plurality of mounting holes and a plurality of recessed areas, each of said recessed areas sized and shaped to receive said fasteners, wherein said planar base has a plurality of rows of uniformly spaced recessed areas each having a hole therein and a flat member having two parallel longitudinal sides formed between two adjacent rows of said recessed areas, with said holes dimensioned the same as a plurality of corresponding mounting holes in the flat member, and four legs extending downwardly from said planar base.

41. A construction toy kit according to claim 40, further comprising a container for holding said elements, said container including a main body having an opening and at least two opposite side walls; and a closure operatively associated with the main body for covering the opening and having means for receiving said platform, wherein said platform has means for engaging said closure and for retaining the container in a closed position, wherein said closure comprises a pair of flap members pivotally connected to the opposite side walls to cover said open top, each of said flap members being provided with two spaced holes.

* * * * *